US011261398B2

(12) United States Patent
Knapton et al.

(10) Patent No.: US 11,261,398 B2
(45) Date of Patent: Mar. 1, 2022

(54) HYDRAULIC FLUID COMPOSITION

(71) Applicant: The Lubrizol Corporation, Wickliffe, OH (US)

(72) Inventors: Daniel J. Knapton, Wickliffe, OH (US); David Cressey, Belper (GB); Daniel C. Visger, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 207 days.

(21) Appl. No.: 16/301,271

(22) PCT Filed: Apr. 19, 2017

(86) PCT No.: PCT/US2017/028306
§ 371 (c)(1),
(2) Date: Nov. 13, 2018

(87) PCT Pub. No.: WO2017/200688
PCT Pub. Date: Nov. 23, 2017

(65) Prior Publication Data

US 2020/0318028 A1 Oct. 8, 2020

Related U.S. Application Data

(60) Provisional application No. 62/338,168, filed on May 18, 2016.

(51) Int. Cl.

| | |
|---|---|
| ***C10M 149/06*** | (2006.01) |
| ***C10N 30/04*** | (2006.01) |
| ***C10N 30/10*** | (2006.01) |
| ***C10N 30/12*** | (2006.01) |
| ***C10N 40/08*** | (2006.01) |
| ***C10N 30/00*** | (2006.01) |

(52) U.S. Cl.
CPC .... *C10M 149/06* (2013.01); *C10M 2201/085* (2013.01); *C10M 2203/003* (2013.01); *C10M 2203/1006* (2013.01); *C10M 2203/1025* (2013.01); *C10M 2209/084* (2013.01); *C10M 2209/086* (2013.01); *C10M 2217/06* (2013.01); *C10M 2223/045* (2013.01); *C10N 2030/04* (2013.01); *C10N 2030/10* (2013.01); *C10N 2030/12* (2013.01); *C10N 2030/24* (2020.05); *C10N 2030/40* (2020.05); *C10N 2040/08* (2013.01)

(58) Field of Classification Search
CPC ..... C10M 169/044; C10M 149/06; C10M 2203/003; C10M 2203/1006; C10M 2203/1025; C10M 2205/04; C10M 2209/082; C10M 2209/084; C10M 2209/086; C10M 2213/02; C10M 2215/28; C10M 2217/06; C10M 2223/045; C10N 2040/08; C10N 2010/04; C10N 2020/04; C10N 2030/02; C10N 2030/04; C10N 2030/10; C10N 2030/12; C10N 2030/24; C10N 2030/40; C10N 2060/09
See application file for complete search history.

(56) References Cited

U.S. PATENT DOCUMENTS

| | | | | |
|---|---|---|---|---|
| 3,231,587 | A | 1/1965 | Rense | |
| 3,197,405 | A | 7/1965 | Le Suer | |
| 3,215,707 | A | 11/1965 | Rense | |
| 3,219,666 | A | 11/1965 | Norman et al. | |
| 3,515,669 | A | 6/1970 | Le Suer | |
| 3,544,465 | A | 12/1970 | Braid | |
| 3,565,804 | A | 2/1971 | Honnen et al. | |
| 3,579,450 | A | 5/1971 | Le Suer | |
| 3,697,574 | A | 10/1972 | Piasek et al. | |
| 3,702,300 | A * | 11/1972 | Coleman et al. | C08F 212/08 508/468 |
| 3,736,357 | A | 5/1973 | Piasek et al. | |
| 3,912,764 | A | 10/1975 | Palmer, Jr. et al. | |
| 4,152,499 | A | 5/1979 | Boerzel et al. | |
| 4,234,435 | A | 11/1980 | Meinhardt et al. | |
| 4,391,721 | A | 7/1983 | Pappas | |
| 4,605,808 | A | 8/1986 | Samson | |
| 4,636,322 | A | 1/1987 | Nalesnik | |
| 4,758,362 | A | 7/1988 | Butke | |
| 4,767,815 | A | 8/1988 | O'Lenick, Jr. | |
| 4,826,615 | A * | 5/1989 | Rossi | C10M 157/04 508/306 |
| 4,839,074 | A | 6/1989 | Rossi et al. | |
| 5,071,919 | A | 12/1991 | DeGonia et al. | |
| 5,137,980 | A | 8/1992 | DeGonia et al. | |
| 5,157,088 | A | 10/1992 | Dishong et al. | |
| 5,254,649 | A | 10/1993 | Miln et al. | |
| 5,286,823 | A | 2/1994 | Rath | |
| 5,330,667 | A | 7/1994 | Tiffany, III et al. | |
| 5,399,275 | A * | 3/1995 | Lange | C10M 169/044 508/470 |
| 5,604,188 | A * | 2/1997 | Ryan | C10M 129/40 508/371 |

(Continued)

FOREIGN PATENT DOCUMENTS

| | | |
|---|---|---|
| EP | 0 203 991 B1 | 12/1986 |
| EP | 0 204 587 A2 | 12/1986 |

(Continued)

OTHER PUBLICATIONS

"Appendix E—API Base Oil Interchangeability Guidelines for Passenger Car Motor Oils and Diesel Engine Oils," section 1.3, "Base Stock Categories" pp. E-1 and E-2 (Apr. 2008).

*Primary Examiner* — James C Goloboy
(74) *Attorney, Agent, or Firm* — Fay Sharpe LLP

(57) ABSTRACT

A hydraulic fluid includes an oil of lubricating viscosity and at least 2 wt. % of an ester of a carboxy group-containing interpolymer comprising units derived from a vinyl aromatic monomer and units derived from a carboxylic acid monomer. The interpolymer also contains nitrogen functionality. The hydraulic fluid is at least substantially free of polyacrylates and polymethacrylates.

17 Claims, No Drawings

(56) References Cited

U.S. PATENT DOCUMENTS

| | | | | |
|---|---|---|---|---|
| 5,627,259 | A | 5/1997 | Thaler et al. | |
| 5,633,326 | A | 5/1997 | Patil et al. | |
| 5,643,859 | A | 7/1997 | Gutierrez et al. | |
| 5,646,099 | A * | 7/1997 | Watts | C10M 169/04 508/232 |
| 5,674,820 | A | 10/1997 | Manka et al. | |
| 5,792,729 | A | 8/1998 | Harrison et al. | |
| 5,851,965 | A | 12/1998 | Harrison et al. | |
| 5,853,434 | A | 12/1998 | Harrison et al. | |
| 5,936,041 | A | 8/1999 | Diana et al. | |
| 6,133,210 | A | 10/2000 | Tipton | |
| 6,544,935 | B1 | 4/2003 | Vargo et al. | |
| 6,559,105 | B2 | 5/2003 | Abraham et al. | |
| 7,285,516 | B2 | 10/2007 | Carrick et al. | |
| 8,361,941 | B2 | 1/2013 | Ramsey | |
| 8,969,266 | B2 | 3/2015 | Crawley et al. | |
| 9,758,743 | B2 | 9/2017 | Knapton et al. | |
| 2004/0110647 | A1 | 6/2004 | Gapinski | |
| 2005/0209112 | A1* | 9/2005 | Clason | C10M 141/10 508/378 |
| 2008/0234153 | A1 | 9/2008 | Matsui | |
| 2008/0302422 | A1* | 12/2008 | Neveu | C10M 171/02 137/3 |
| 2009/0305923 | A1* | 12/2009 | Visger | C08F 8/14 508/296 |
| 2009/0312210 | A1 | 12/2009 | Grisso et al. | |
| 2010/0197536 | A1 | 8/2010 | Mosier et al. | |
| 2013/0005628 | A1 | 1/2013 | Visger et al. | |
| 2013/0203638 | A1 | 8/2013 | Crawley et al. | |
| 2014/0051615 | A1 | 2/2014 | Salomon et al. | |
| 2015/0099675 | A1 | 4/2015 | Hum et al. | |
| 2016/0040089 | A1 | 11/2016 | Baker et al. | |

FOREIGN PATENT DOCUMENTS

| | | |
|---|---|---|
| EP | 1 200 541 B1 | 2/2010 |
| EP | 2 814 921 B1 | 11/2017 |
| WO | WO 1986/003221 | 6/1986 |
| WO | WO 2008/147704 | 12/2008 |
| WO | WO 2011/153178 A2 | 12/2011 |
| WO | WO 2013/062924 A2 | 5/2013 |
| WO | WO 2013/123102 A2 | 8/2013 |

* cited by examiner

HYDRAULIC FLUID COMPOSITION

This application claims the benefit of PCT/US2017/028306, filed Apr. 19, 2017, and U.S. Provisional Application No. 62/338,168; filed May 18, 2016, from which the PCT application claims priority, the disclosures of which are incorporated herein by reference in their entireties.

BACKGROUND

The invention relates generally to hydraulic fluids and finds particular application in connection with a hydraulic fluid suited to use in hydraulic systems that with a compound that serves as a dispersant and/or viscosity modifier that does not appreciably impact the ability of the hydraulic fluid to demulsify water.

Hydraulic fluids serve to transmit power from a source, such as a pump, to another component of a hydraulic system, such as a motor, power steering, brake system, or the like. Hydraulic fluids also serve as lubricants and help to minimize wear, reduce friction, provide cooling, prevent rust and corrosion and minimize deposits and contamination. Over time, however, deposits and varnish can build up on components of the hydraulic system. This can lead to higher friction, sticking of hydraulic valves, hindering of oil flow, impacting cooling capacity, and shortening of component life. It would be desirable to incorporate a dispersant in the hydraulic fluid to mitigate these effects.

Polymeric viscosity index (VI) improvers and their functionalized derivative compositions (dispersant VI improvers) are well known to provide deposit control in lubricant applications such as automatic transmission fluids (ATF), manual transmission fluids (MTF), engine oils (EO) and automotive gear oils (AGO). These VI improvers commonly include polyalkyl(meth)acrylates, hydrogenated styrene-butadiene or -isoprene copolymers, ethylene propylene copolymers, and maleic anhydride-styrene ester copolymers. However, a requirement of hydraulic lubricants is demulsibility. This is the ability to separate out water that enters the hydraulic system. As a result, conventional dispersant VI improvers have not found use in hydraulic lubricants due to their negative impact on the ability of the fluid to demulsify water.

The most common VI improvers found in multigrade hydraulic lubricants are non-dispersant polyalkyl(meth) acrylates because of their ability to impart high VI, excellent low temperature flow and good water demulsification properties. It would be advantageous to discover a dispersant VI improver with the same high and low temperature viscometric properties as the polyalkyl(meth)acrylate but with the ability to provide good water demuisibility performance.

U.S. Pat. No. 4,826,615 disclosed an automatic transmission fluid containing a dual additive combination of a polymethacrylate and an esterified interpolymer of styrene and a carboxyl containing monomer anhydride.

U.S. Pat. No. 5,157,088 discloses transmission, hydraulic and gear fluids containing a nitrogen-containing ester of a carboxy-containing terpolymer of maleic anhydride, styrene, and methylmethacrylate.

U.S. Pat. No. 6,133,210 discloses a composition containing a polymeric carboxylic ester viscosity improver optionally containing nitrogen-containing groups, and at least one hydrocarbyl group substituted ashless dispersant.

U.S. Pub. No. 20040110647 discloses a tractor hydraulic fluid containing a polyacrylate or polymethacrylate polymer and a polymer having vinyl aromatic units and esterified carboxyl-containing units.

U.S. Pub. No. 20080234153 discloses a lubricating composition with a styrene-maleic anhydride ester copolymer.

U.S. Pub. No. 20130005628 discloses a lubricating composition containing an esterified interpolymer of a vinyl aromatic monomer and a carboxylic monomer, having pendent groups.

WO2013062924 describes esterified polymers based on esters of maleic anhydride and styrene-containing polymers that are further reacted with a dispersant monomer (typically nitrogen-containing monomer, hydroxyl-containing monomer, or an alkoxylated monomer) to form a dispersant viscosity modifier.

However, these compositions are generally unsuited to use in hydraulic systems.

There remains a need for a dispersant-containing hydraulic fluid which can improve varnish and deposit control of a hydraulic system while maintaining the demulsibility of the hydraulic fluid.

BRIEF DESCRIPTION

In accordance with one aspect of the exemplary embodiment, a hydraulic fluid includes an oil of lubricating viscosity and at least 2 wt. % of an ester of a carboxy group-containing interpolymer comprising units derived from a vinyl aromatic monomer and units derived from a carboxylic acid monomer. The interpolymer also includes nitrogen functionality. The hydraulic fluid is at least substantially free of polyacrylates and polymethacrylates.

In accordance with another aspect of the exemplary embodiment a method of lubricating a hydraulic system includes pressurizing the hydraulic fluid in the hydraulic system.

In accordance with another aspect of the exemplary embodiment, a hydraulic system includes a pump and a device which is supplied with the hydraulic fluid by the pump.

In accordance with another aspect of the exemplary embodiment, the hydraulic fluid is used in a hydraulic system.

DETAILED DESCRIPTION

One aspect of the exemplary embodiment relates to a hydraulic fluid which includes an oil of lubricating viscosity and an ester of a carboxy group-containing interpolymer which is nitrogen-functionalized (referred to herein for brevity as an esterified copolymer). The esterified copolymer includes units derived from a carboxylic acid monomer and units derived from a vinyl monomer. The esterified copolymer can serve as both a dispersant and a viscosity modifier in the hydraulic fluid, and has the ability to provide good water demulsibility performance.

Another aspect of the exemplary embodiment relates to a method of lubricating a hydraulic system with the hydraulic fluid. The hydraulic fluid is particularly suited to lubrication of hydraulic systems where it can improve deposit and varnish control of the hydraulic system while maintaining demulsibility.

Another aspect of the exemplary embodiment relates to a hydraulic system in which the hydraulic fluid is pumped to a device under pressure by a pump, for operating the device.

The exemplary esterified copolymer has a backbone comprising the units derived from the carboxylic acid monomer and the units derived from a vinyl aromatic monomer and pendent groups provided by esterification and nitrogen functionalization. It is believed that the backbone is largely responsible for the demulsibility properties of the esterified copolymer, while the nitrogen functionality provides deposit and varnish control.

In the exemplary esterified copolymer, a majority of the backbone (such as at least 60%, or at least 70%, or at least 80%, or at least 90%, or at least 95%, such as 70%-95%, and up to 100% of the units in the backbone), is derived from the vinyl monomer and the carboxylic acid monomer. In one embodiment, less than 5% or less than 1% or less than 0.1%, or 0% of the units in the backbone are derived from acrylic acid, acrylate, or methacrylate (i.e., is at least substantially free of methacrylate and acrylate units). Pendent groups may be grafted to the backbone, such as by esterification and amidization/imidization of the units of the backbone that are derived from the carboxylic acid monomer. In general, the polymeric backbone can be an alternating structure whereby the majority of carboxylic acid units are spaced from the next carboxylic acid unit by at least one unit derived from a vinyl aliphatic monomer. The exemplary esterified copolymer can have at least 20 or at least 100 units derived from these monomers in its backbone. In one embodiment, the backbone chain of monomer units derived from the selected monomers is of no more than 10,000 such monomer units, or no more than 1000 such monomer units.

Weight average molecular weight ($M_w$) as used herein, is measured by gel permeation chromatography (GPC), also known as size-exclusion chromatography, employing a polystyrene standard. Typically the weight average molecular weight is measured on the final esterified copolymer, optionally reacted with a nitrogen-containing compound. The $M_w$ of the exemplary polymer backbone, before esterification, can range from 3000 to 50,000, and in one embodiment, may be at least 10,000, such as at least 20,000, or at least 25,000. The $M_w$ of the exemplary esterified polymer, after esterification and optional reaction with the nitrogen-containing compound, can range from 20,000 to 200,000, and in one embodiment, may be 30,000 to 70,000, such as 40,000 to 60,000. In another embodiment, the $M_w$ of the esterified polymer is 10,000 to 300,000.

The molecular weight of the esterified polymer may also be expressed in terms of the "reduced specific viscosity" of the polymer. As used herein, the reduced specific viscosity (RSV) is the value obtained in accordance with the formula RSV=(Relative Viscosity−1)/Concentration, wherein the relative viscosity is determined by measuring, by means of a dilution viscometer, the viscosity of a solution of 1 g of the polymer in 10 $cm^3$ of acetone and the viscosity of acetone at 30° C. For purposes of computation by the above formula, the concentration is adjusted to 0.4 g of the esterified polymer per 10 $cm^3$ of acetone. A more detailed discussion of the reduced specific viscosity, also known as the specific viscosity, as well as its relationship to the average molecular weight of an interpolymer, appears in Paul J. Flory, Principles of Polymer Chemistry, (1953 Edition) pages 308, et seq. The exemplary esterified polymer may have an RSV of from 0.05 to 2, or 0.06 to 1, or 0.08 to 0.3. In another embodiment the RSV is 0.2.

The esterified copolymer may have a kinematic viscosity (KV_100), measured according to ASTM D445, as noted in the Examples below, of at least 300, or up to 600, such as at least 350, or at least 400, or up to 550, such as 350-550 or 450-550.

Vinyl Monomer

The vinyl monomer can be selected from polymerizable vinyl aromatic monomers. An exemplary vinyl aromatic monomer is an aromatic compound substituted with a vinyl group (—CH═$CH_2$).

Suitable vinyl aromatic monomers are those corresponding to Formula I:

Formula I

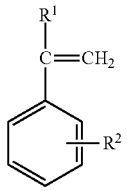

wherein $R^1$ and $R^2$ independently represent a hydrogen atom, an alkyl group having 1 to 4 carbon atoms, or a halogen containing group. The vinyl aromatic monomer may be selected from styrene, alpha-alkylstyrenes, nuclear alkylstyrenes, chlorostyrenes, dichlorostyrenes, vinylnaphthalene, and mixtures of these. Specific examples include styrene, alpha-methylstyrene, alpha-ethyistyrene, alpha-isopropylstyrene, alpha-tert-butylstyrene, nuclear alkylstyrenes such as o-methylstyrene, m-methylstyrene, p-methylstyrene, o-methyl-alpha-methylstyrene, m-methyl-alpha-methylstyrene, p-methyl-alpha-methylstyrene, m-isopropyl-alpha-methylstyrene, p-isopropyl-alpha-methylstyrene, m-isopropylstyrene, p-isopropylstyrene, vinylnaphthalene, and mixtures thereof.

Carboxylic Acid Monomer

The carboxylic acid monomer may be an ethylenically unsaturated carboxylic acid or anhydride or ester thereof. In the exemplary unsaturated carboxylic acids or anhydrides or esters thereof, a carbon-to-carbon double bond is typically in an alpha, beta-position relative to at least one of the carboxy functions (e.g., in the case of itaconic acid, anhydride or ester thereof) and may be in an alpha, beta-position to both of the carboxy functions of an alpha, beta-dicarboxylic acid, anhydride or the ester thereof (e.g., in the case of maleic acid or anhydride, fumaric acid, or ester thereof). In one embodiment, the carboxy functions of these compounds are separated by up to 4 carbon atoms, such as 2 carbon atoms.

Examples of carboxylic acid monomers useful herein include α,β-ethylenically unsaturated carboxylic acids selected from maleic acid, fumaric acid, itaconic acid, cinnamic acid, 2-methyleneglutaric acid, and anhydrides and mixtures thereof, and substituted equivalents thereof. Suitable examples of monomers for forming the carboxylic acid unit include itaconic anhydride, maleic anhydride, methyl maleic anhydride, ethyl maleic anhydride, dimethyl maleic anhydride, and mixtures thereof. In one embodiment, the carboxylic acid unit includes units derived from maleic anhydride or derivatives thereof. Other suitable monomers for forming the carboxylic acid monomer unit of the exemplary esterified copolymer are described in U.S. Pub. No. 20090305923.

By way of example, the exemplary copolymer can include a polymeric backbone derived from styrene, as the vinyl aliphatic monomer, and maleic anhydride, as the carboxylic acid monomer.

A molar ratio of the vinyl monomer units to carboxylic acid monomer units in the copolymer can be for example, from 1:3 to 3:1 or from 0.6:1 to 1.2:1, or from 0.9:1 to 1.1:1. In one embodiment, the molar ratio is about 0.7:1 to 1:1.1 in the esterified copolymer. It is to be appreciated, however, that the molar ratios used in the preparation of the copolymer may differ from those in the copolymer.

Esterification of the Carboxylic Acid Units

Esterification of the units derived from a carboxylic acid monomer may be performed with an alcohol, such as a primary and/or secondary alcohol. At least 65%, or at least 70%, or at least 80%, or at least 90%, or up to 99%, or up to 98%, or up to 95%, or up to 90%, of the units derived from a carboxylic acid monomer may be esterified. In one embodiment, a mixture of alcohols may be used to provide pendent groups of different lengths.

Suitable primary alcohols for use herein may contain 4 to 60 carbon atoms, e.g., at least $C_4$, or at least $C_6$, or at least $C_8$ alcohols, and in some embodiments, up to a $C_{24}$, or up to a $C_{20}$, or up to a $C_{18}$, or up to a $C_{16}$ alcohol. Mixtures of alcohols are contemplated. In one embodiment, the alcohol mixture used to esterify the copolymer is at least 50 wt. %, or at least 60 wt. %, or at least 80 wt. %, or at least 90 wt. % of alcohols with at least 8 aliphatic carbon atoms, or at least 10 aliphatic carbon atoms. In one embodiment, the alcohol mixture used to form the ester groups contains no more than 5.0 wt. % of $C_{18}$ and higher linear alcohol, or no more than 2 wt. % or no more than 1 wt. %. In one embodiment, the alcohol mixture includes at least 0.1 wt. % of $C_{18}$-$C_{20}$ linear alcohols.

The primary alcohol may be linear or may be branched at the α-, or β-, or higher position. In one embodiment, a mixture of linear and branched alcohols is employed in forming the esterified copolymer described herein. In one exemplary embodiment, at least 0.1% of the carboxylic acid units in the copolymer are esterified with an alcohol branched at the β- or higher position.

In one embodiment, 20 or 30 to 100 mole %, or 30 to 70 mole %, based on the total number of moles of carboxyl groups in the copolymer, contain ester groups having 12 to 19 carbon atoms in the alcohol group (that is, in the alcohol-derived or alkoxy portion of the ester) and 70 or 80 to 0 mole %, alternatively 80 to 30 mole %, based on the total number of moles of carboxyl groups in the esterified copolymer, contain ester groups having 8 to 11 carbon atoms in the alcohol portion. In one embodiment, the ester contains at least 45 mole %, based on moles of carboxyl groups in the esterified copolymer, of ester groups containing from 12 to 18 carbon atoms in the alcohol portion. In an optional embodiment, the esterified copolymer has up to 20 mole % or 0 to 5% or 1 to 2%, based on the total number of moles of carboxyl groups in the copolymer, of ester groups having from 1 to 6 carbon atoms in the alcohol portion. In one embodiment, the compositions are substantially free of ester groups containing from 3 to 7 carbon atoms.

In one embodiment, 0.1 to 99.89 (or 1 to 50, or 2.5 to 20, or 5 to 15) percent of the carboxylic acid units esterified are esterified with a primary alcohol branched at the β- or higher position, 0.1 to 99.89 (or 1 to 50, or 2.5 to 20, or 5 to 15) percent of the carboxylic acid units esterified are esterified with a linear alcohol or an alpha-branched alcohol, and 0.01 to 10% (or 0.1% to 20%, or 0.02% to 7.5%, or 0.1 to 5%, or 0.1 to less than 2%) of the carboxylic acid units has at least one nitrogen-containing group, such as an amino-, amido- and/or imido-group, as described below. As an example, 5 to 15 percent of the carboxylic acid units of the copolymer are esterified with a primary alcohol branched at the β- or higher position, 0.1 to 95 percent of the carboxylic acid units are esterified with a linear alcohol or an alpha-branched alcohol, and 0.1 to less than 2% of the carboxylic acid units has at least one nitrogen-containing group.

Examples of useful primary alcohols include butanol, pentanol, hexanol, heptanol, octanol, 2-ethylhexanol, decanol, dodecanol, tridecanol, tetradecanol, pentadecanol, hexadecanol, heptadecanol, octadecanol, and combinations thereof. In one embodiment, the primary alcohol may be a diol or higher order polyol. Examples of useful polyols include ethylene glycol, trimethylolpropane, pentaerythritol, glycerol, 1,4-butanediol, 1,6 hexanediol, and combinations thereof.

Other exemplary primary alcohols include commercially available mixtures of alcohols. These include oxoalcohols which may comprise, for example, various mixtures of alcohols having from 8-24 carbon atoms. Of the various commercial alcohols useful herein, one contains 8 to 11 carbon atoms, and another 12 to 18 aliphatic carbon atoms. The alcohols in the mixture may include one or more of, for example, octyl alcohol, nonyl alcohol, decyl alcohol, undecyl alcohol, dodecyl alcohol, tetradecyl alcohol, pentadecyl alcohol, and octadecyl alcohol. Several suitable sources of these alcohol mixtures are the technical grade alcohols sold under the name NEODOL® alcohols (Shell Oil Company, Houston, Tex.) and under the name ALFOL® alcohols (Sasol, Westlake, La.), and fatty alcohols derived from animal and vegetable fats and sold commercially by, for example, Henkel, Sasol, and Emery.

Tertiary alkanolamines, i.e., N,N-di-(lower alkyl)amino alkanolamines, are other alcohols that may be used to prepare the esterified copolymers. Examples include N,N-dimethylethanolamine, N,N-diethylethanolamine, 5-diethylamino-2-pentanol, and combinations thereof.

Exemplary primary alcohols branched at the β- or higher position may include Guerbet alcohols. Methods to prepare Guerbet alcohols are disclosed in U.S. Pat. No. 4,767,815 (see column 5, line 39 to column 6, line 32).

The primary alcohol branched at the β- or higher position may be used to provide pendent groups as represented within $(\ )_w$ of the Formula II:

Formula II

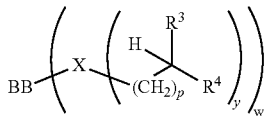

wherein (BB) is a copolymer backbone comprising the carboxylic acid monomer units and vinyl monomer units;

X is a functional group which either (i) contains a carbon and at least one oxygen or nitrogen atom or (ii) is an alkylene group with 1 to 5 carbon atoms (typically —$CH_2$—), connecting the copolymer backbone and a branched hydrocarbyl group contained within $(\ )_y$;

w is the number of pendent groups attached to the copolymer backbone, which may be in the range of 2 to 2000, or 2 to 500, or 5 to 250;

y is 0, 1, 2 or 3, provided that in at least 1 mol. % of the pendent groups, y is not zero; and with the proviso that when y is 0, X is bonded to a terminal group in a manner sufficient to satisfy the valence of X, wherein the terminal group is selected from hydrogen, alkyl, aryl, a metal (typically introduced during neutralization of ester reactions. Suitable metals include calcium, magnesium, barium, zinc, sodium, potassium or lithium) or ammonium cation, and mixtures thereof;

p is an integer in the range of 1 to 15 (or 1 to 8, or 1 to 4);

$R^3$ and $R^4$ are independently linear or branched hydrocarbyl groups, and the combined total number of carbon atoms present in $R^3$ and $R^4$ is at least 12 (or at least 16, or at least 18 or at least 20).

In different embodiments the copolymer with pendent groups may contain 0.10% to 100%, or 0.5% to 20%, or 0.75% to 10%, branched hydrocarbyl groups represented by a group within $(\ )_y$ of the Formula II, expressed as a percentage of the total number of pendent groups. The pendent groups of Formula II may also be used to define the ester groups as defined above by the phrase "a primary alcohol branched at the β- or higher position".

In different embodiments the functional groups defined by X in Formula II above, may comprise at least one of $—CO_2—$, $—C(O)N=$ or $—(CH_2)_v—$, wherein v is an integer in the range of 1 to 20, or 1 to 10, or 1 to 2.

In one embodiment X is derived from an α,β-ethylenically unsaturated dicarboxylic acid or derivatives thereof. Examples of suitable carboxylic acids or derivatives thereof may include maleic anhydride, maleic acid, (meth)acrylic acid, itaconic anhydride, cinnamic acid, or itaconic acid. In one embodiment, the ethylenically unsaturated carboxylic acid or derivatives thereof may be at least one of maleic anhydride and maleic acid.

In one embodiment X is other than an alkylene group, connecting the copolymer backbone and the branched hydrocarbyl groups.

In different embodiments the pendent groups may be esterified, amidated or imidated functional groups.

Examples of suitable groups for $R^3$ and $R^4$ in Formula II include; alkyl groups containing $C_{15-16}$ polymethylene groups, such as 2-$C_{1-15}$ alkyl-hexadecyl groups (e.g., 2-octylhexadecyl) and 2-alkyl-octadecyl groups (e.g., 2-ethyloctadecyl, 2-tetradecyl-octadecyl and 2-hexadecyloctadecyl); alkyl groups containing $C_{13-14}$ polymethylene groups, such as 1-$C_{1-15}$ alkyl-tetradecyl groups (e.g., 2-hexyltetradecyl, 2-decyltetradecyl and 2-undecyltridecyl) and 2-$C_{1-15}$ alkyl-hexadecyl groups (e.g., 2-ethyl-hexadecyl and 2-dodecyl-hexadecyl); alkyl groups containing $C_{10-12}$ polymethylene groups, such as 2-$C_{1-15}$ alkyl-dodecyl groups (e.g., 2-octyl-dodecyl) and 2-$C_{1-15}$ alkyl-dodecyl groups (2-hexyldodecyl and 2-octyldodecyl), 2-$C_{1-15}$ alkyl-tetradecyl groups (e.g., 2-hexyltetradecyl and 2-decyltetradecyl); alkyl groups containing $C_{6-9}$ polymethylene groups, such as 2-$C_{1-15}$ alkyl-decyl groups (e.g., 2-octyldecyl) and 2,4-di-$C_{1-15}$ alkyl-decyl groups (e.g., 2-ethyl-4-butyl-decyl); alkyl groups containing $C_{1-5}$ polymethylene groups, such as 2-(3-methylhexyl)-7-methyl-decyl and 2-(1,4,4-trimethylbutyl)-5,7,7-trimethyl-octyl groups; and mixtures of two or more branched alkyl groups, such as alkyl residues of oxo alcohols corresponding to propylene oligomers (from hexamer to undecamer), ethylene/propylene (molar ratio 16:1-1:11) oligomers, isobutene oligomers (from pentamer to octamer), and $C_{5-17}$ α-olefin oligomers (from dimer to hexamer).

The pendent groups in Formula II may contain a total combined number of carbon atoms on $R^3$ and $R^4$ in the range of 12 to 60, or 14 to 50, or 16 to 40, or 18 to 40, or 20 to 36.

Each of $R^3$ and $R^4$ may individually contain 5 to 25, or 8 to 32, or 10 to 18 methylene carbon atoms. In one embodiment, the number of carbon atoms on each $R^3$ and $R^4$ group may be 10 to 24.

In different embodiments, the primary alcohol branched at the β- or higher position may have at least 12 (or at least 16, or at least 18 or at least 20) carbon atoms. The number of carbon atoms may range from at least 12 to 60, or at least 16 to 30.

Examples of suitable primary alcohols branched at the β- or higher position include 2-ethylhexanol, 2-butyloctanol, 2-hexyldecanol, 2-octyldodecanol, 2-decyltetradecanol, and mixtures thereof.

Nitrogen-Containing Group

At least 1%, or at least 2% or at least 3% or at least 4%, or at least 5%, or at least 10% of the units derived from a carboxylic acid monomer in the exemplary esterified copolymer, and in some embodiments, up to 35% (e.g., up to all remaining after esterification) may be nitrogen functionalized to provide the exemplary esterified copolymer with a nitrogen-containing moiety or moieties such as an amino-, amino- and/or imido-group, or mixture thereof. In one embodiment, the nitrogen functionality is provided by nitrogen-containing moieties condensed onto at least 10 or up to 35% of the carboxy groups of the interpolymer (prior to esterification).

The nitrogen-containing group may be derived from a nitrogen-containing compound capable of being incorporated during copolymerization (or through reaction with the carboxylic acid units to form a salt), such as an amine, amide, imide, or mixture thereof, e.g., through being aminated (as used herein, this includes forming salts of the carboxylic acid units), amidated, and/or imidated with a nitrogen-containing compound.

The ester group and/or nitrogen containing group may be sufficient to provide at least 0.01 wt. %, or at least 0.02 wt. %, or at least 0.04 wt. %, or at least 0.1 wt. %, or at least 0.2 wt. % nitrogen to the esterified copolymer, and in some embodiments, up to 1.5 wt. %, or up to 0.75 wt. %, or up to 0.6 wt. % nitrogen or up to 0.4 wt. %, or up to 0.25 wt. %, such as 0.01 wt. % to 1.5 wt. %, or 0.02 wt. % to 0.75 wt. %, or 0.04 wt. % to 0.25 wt. %, or 0.1 to 0.4 wt. % nitrogen. Nitrogen content is determined according to ASTM D5291, as noted in the Examples below.

The nitrogen-containing group may be derived from a primary or secondary amine, such as an aliphatic amine, aromatic amine, aliphatic polyamine, aromatic polyamine, polyaromatic polyamine, or combination thereof.

In one embodiment, the nitrogen containing group may be derived from an aliphatic amine, such as a $C_1$-$C_{30}$ or $C_1$-$C_{24}$ aliphatic amine. Examples of suitable aliphatic amines include aliphatic monoamines and diamines, which may be linear or cyclic. Examples of suitable primary amines include methylamine, ethylamine, propylamine, butylamine, pentylamine, hexylamine, heptylamine, octylamine, decylamine, dodecylamine, tetradecylamine, hexadecylamine octadecylamine, oleylamine, dimethylaminopropylamine, diethylaminopropylamine, dibutylaminopropylamine, dimethylaminoethylamine, diethylaminoethylamine, and dibutylaminoethylamine. Examples of suitable secondary amines include dimethylamine, diethylamine, dipropylamine, dibutylamine, diamylamine, dihexylamine, diheptylamine, methylethylamine, ethylbutylamine, diethylhexylamine, and ethylamylamine. The secondary amines may be cyclic amines such as aminoethylmorpholine, aminopropylmorpholine, 1-(2-aminoethyl)pyrrolidone, piperidine, 1-(2-aminoethyl)piperidine, piperazine and morpholine. Examples of suitable aliphatic polyamines include tetraethylenepentamine, pentaethylenehexamine, diethylenetriamine, triethylenetetramine, and polyethyleneimine.

Particularly suitable nitrogen-containing compounds capable of being incorporated into the copolymer include N,N-dimethylacrylamide, N-vinyl carbonamides, such as, N-vinyl-formamide, N-vinylacetamide, N-vinyl propionamides, N-vinyl hydroxyacetamide, vinyl pyridine, N-vinyl imidazole, N-vinyl pyrrolidinone, N-vinyl caprolactam, dimethylaminoethyl acrylate, dimethylaminoethyl methacrylate, dimethylaminobutyl acrylamide, dimethylaminopropyl methacrylate, dimethylaminopropyl acrylamide, dimethylaminopropyl methacrylamide, dimethylaminoethyl acrylamide, and mixtures thereof.

In one embodiment, the amine component of the copolymer further includes an amine having at least two N—H groups capable of condensing with the carboxylic functionality of the copolymer. This material is referred to hereinafter as a "linking amine" as it can be employed to link together two of the copolymers containing the carboxylic acid functionality. It has been observed that higher molecular weight materials may provide improved performance, and this is one method to increase the material's molecular weight. The linking amine can be either an aliphatic amine or an aromatic amine; if it is an aromatic amine, it is considered to be in addition to and a distinct element from the aromatic amine described above, which typically will have only one condensable or reactive NH group, in order to avoid excessive crosslinking of the copolymer chains. Examples of such linking amines include ethylenediamine, phenylenediamine, and 2,4-diaminotoluene; others include propylenediamine, hexamethylenediamine, and other, ω-polymethylenediamines. The amount of reactive functionality on such a linking amine can be reduced, if desired, by reaction with less than a stoichiometric amount of a blocking material such as a hydrocarbyl-substituted succinic anhydride.

In one embodiment, the amine includes nitrogen-containing compounds capable of reacting directly with a copolymer backbone. Examples of suitable amines include N-p-diphenylamine, 4-anilinophenyl methacrylamide, 4-anilinophenyl maleimide, 4-anilinophenyl itaconamide, acrylate and methacrylate esters of 4-hydroxydiphenylamine, and the reaction product of p-aminodiphenylamine or p-alkylaminodiphenylamine with glycidyl methacrylate.

In one embodiment, the exemplary esterified copolymer provides for deposit and varnish control. Typically, the copolymer with deposit and varnish control contains an incorporated residue of an amine-containing compound such as morpholines, pyrrolidinones, imidazolidinones, amino amides (such as acetamides), β-alanine alkyl esters, and mixtures thereof. Examples of suitable nitrogen-containing compounds include 3-morpholin-4-yl-propylamine, 3-morpholin-4-yl-ethylamine, β-alanine alkyl esters (typically alkyl esters have 1 to 30, or 6 to 20 carbon atoms), or mixtures thereof.

In one embodiment, the compounds based on imidazolidinones, cyclic carbamates or pyrrolidinones may be derived from a compound of general structure:

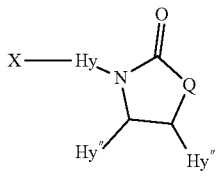

wherein

X=—OH or $NH_2$;

Hy" is hydrogen, or a hydrocarbyl group (typically alkyl, or $C_{1-4}$—, or $C_2$-alkyl);

Hy is a hydrocarbylene group (typically alkylene, or $C_{1-4}$—, or $C_2$-alkylene);

Q=>NH, >NR, >$CH_2$, >CHR, >$CR_2$, or —O— (typically >NH, or >NR) and

R is a $C_{1-4}$ alkyl.

In one embodiment, the imidazolidinone includes 1-(2-amino-ethyl)-imidazolidin-2-one (may also be called aminoethylethyleneurea), 1-(3-amino-propyl)-imidazolidin-2-one, 1-(2-hydroxy-ethyl)-imidazolidin-2-one, 1-(3-amino-propyl)-pyrrolidin-2-one, 1-(3-amino-ethyl)-pyrrolidin-2-one, or mixtures thereof.

In one embodiment, the acetamide may be represented by the general structure:

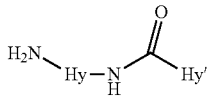

wherein:

Hy is a hydrocarbylene group (typically alkylene, or $C_{1-4}$—, or $C_2$-alkylene); and Hy' is a hydrocarbyl group (typically alkyl, or $C_{1-4}$—, or methyl).

Examples of suitable acetamides include N-(2-amino-ethyl)-acetamide and N-(2-amino-propyl)-acetamide.

In one embodiment, the β-alanine alkyl esters may be represented by the general structure:

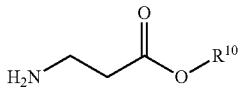

wherein:

$R^{10}$ is an alkyl group having 1 to 30, or 6 to 20 carbon atoms.

Examples of suitable β-alanine alkyl esters include β-alanine octyl ester, β-alanine decyl ester, β-alanine 2-ethylhexyl ester, β-alanine dodecyl ester, β-alanine tetradecyl ester, or β-alanine hexadecyl ester.

In one embodiment, the copolymer may be reacted with an amine-containing compound selected from morpholines, imidazolidinones, and mixtures thereof. In one embodiment, the nitrogen-containing compound is selected from 1-(2-aminoethyl)imidazolidinone, 4-(3-aminopropyl)morpholine, 3-(dimethylamino)-1-propylamine, N-phenyl-p-phenylenediamine, N-(3-aminopropyl)-2-pyrrolidinone, aminoethyl acetamide, β-alanine methyl ester, 1-(3-amino-propyl) imidazole, and combinations thereof.

Hydraulic Fluid

The esterified copolymer may be present in the hydraulic fluid at a concentration of at least 2 wt. %, such as at least 2.5 wt. %, or at least 3 wt. %, or at least 4 wt. %. The esterified copolymer may be up to 12 wt. %, or up to 10 wt. %, or up to 8 wt. %, or up to 6 wt. % of the hydraulic fluid. The weight of the esterified copolymer is determined on an oil-free basis.

The hydraulic fluid may have a kinematic viscosity (KV_40) according to ASTM D445, of from 15-100 cSt, such as at least 20, or at least 30, or up to 80.

The hydraulic fluid may include, in addition to the esterified copolymer, an oil of lubricating viscosity and one or more other performance additives. The other performance additives (which do not include water) may be present in the hydraulic fluid at a total concentration of up to 8 wt. %, such as up to 6 wt. %, or up to 3 wt. %, or up to 2 wt. %, or up to 1 wt. % or up to 0.5 wt. %, and in one embodiment, at least 0.01 wt. % of the other performance additives.

Oil of Lubricating Viscosity

The hydraulic fluid may include the oil of lubricating viscosity as a minor or major component thereof, such as at least 5 wt. %, or at least 20 wt. %, or at least 30 wt. %, or at least 40 wt. %, or at least 60 wt. % of the hydraulic fluid.

Suitable oils of lubricating viscosity include natural and synthetic oils, oils derived from hydrocracking, hydrogenation, and hydrofinishing, unrefined, refined and re-refined oils, and mixtures thereof.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

A more detailed description of unrefined, refined and re-refined oils is provided in International Publication WO 2008/147704, paragraphs [0054] to [0056] (a similar disclosure is provided in US Patent Application 2010/197536, see [0072] to [0073]). A more detailed description of natural and synthetic lubricating oils is described in paragraphs [0058] to [0059] respectively of WO 2008/147704 (a similar disclosure is provided in US Patent Application 2010/197536, see [0075] to [0076]).

Natural oils useful in as oils of lubricating viscosity include animal oils or vegetable oils (e.g., castor oil or lard oil), mineral lubricating oils, such as liquid petroleum oils and solvent-treated or acid-treated mineral lubricating oils of the paraffinic, naphthenic or mixed paraffinic-naphthenic types, and oils derived from coal or shale or mixtures thereof.

Oils of lubricating viscosity may also be defined as specified in the April 2008 version of "Appendix E—API Base Oil Interchangeability Guidelines for Passenger Car Motor Oils and Diesel Engine Oils," section 1.3 Subheading 1.3. "Base Stock Categories." The API Guidelines are also summarized in U.S. Pat. No. 7,285,516 (see column 11, line 64 to column 12, line 10). In one embodiment, the oil of lubricating viscosity may be an API Group II, Group III, Group IV oil, or mixtures thereof. The five base oil groups are as follows: Group I (sulfur content >0.03 wt. %, and/or <90 wt. % saturates, viscosity index 80-120); Group II (sulfur content ≤0.03 wt. %, and ≥90 wt. % saturates, viscosity index 80-120); Group III (sulfur content ≤0.03 wt. %, and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group 1V oil, or mixtures thereof. In some embodiments, the oil of lubricating viscosity is an API Group I, Group II, or Group III oil, or mixture thereof.

Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid (GTL) oils. Synthetic lubricating oils useful as oils of lubricating viscosity include hydrocarbon oils, such as polymerized and copolymerized olefins (e.g., polybutylenes, polypropylenes, propyleneisobutylene copolymers); poly(l-hexenes), poly(1-octenes), poly(1-decenes), and mixtures thereof; alkyl-benzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof, and mixtures thereof.

In one embodiment, the oil of lubricating viscosity has little natural ability to swell seals, for example, a polyalphaolefin (PAO) or GTL oil. Both PAO and GTL base stocks are highly paraffinic in nature (low levels of aromaticity). PAOs are 100% isoparaffinic with essentially zero percent aromatics. Similarly, GTL base oils have a very highly paraffinic content and again, essentially zero aromatic content. As a result, both PAO and GTL base oils are regarded as having low solvency and poor lubricant additive solubility performance. They also exhibit little natural ability to swell seals.

The oil of lubricating viscosity may be an API Group IV oil, or mixtures thereof, i.e., a polyalphaolefin. Polyalphaolefin base oils, and their manufacture, are generally well known. The PAO base oils may be derived from linear $C_2$ to $C_{32}$ alpha olefins, such as $C_4$ to $C_{16}$, alpha olefins. Example feedstocks for forming PAOs include 1-octene, 1-decene, 1-dodecene and 1-tetradecene. An exemplary PAO has a kinematic viscosity at 100° C. of about 3.96 $mm^2s^{-1}$ and a VI of 101. The polyalphaolefin may be prepared by metallocene catalyzed processes or from a non-metallocene process.

GTL base oils include base oils obtained by one or more possible types of GTL processes, typically a Fischer-Tropsch process. The GTL process takes natural gas, predominantly methane, and chemically converts it to synthesis gas, or syngas. Alternatively, solid coal can also be converted into synthesis gas. Synthesis gas mainly contains carbon monoxide (CO) and hydrogen ($H_2$), which are mostly subsequently chemically converted to paraffins by a catalytic Fischer-Tropsch process. These paraffins will have a range of molecular weights and by the use of catalysts can be hydroisomerized to produce a range of base oils. GTL base stocks have a highly paraffinic character, typically greater than 90% saturates. Of these paraffinics, the non-cyclic paraffinic species predominate over the cyclic paraffinic species. For example, GTL base stocks typically include greater than 60 wt. %, or greater than 80 wt. %, or greater than 90 wt. % non-cyclic paraffinic species. GTL base oils typically have a kinematic viscosity at 100° C. of between 2 $mm^2\ s^{-1}$ and 50 $mm^2\ s^{-1}$, or 3 $mm^2\ s^{-1}$ to 50 $mm^2\ s^{-1}$, or 3.5 $mm^2\ s^{-1}$ to 30 $mm^2\ s^{-1}$. One example of a GTL has a kinematic viscosity at 100° C. of about 4.1 $mm^2\ s^{-1}$. Likewise, the GTL base stocks are typically characterized as having a viscosity index according to ASTM D2270 of 80 or greater, or 100 or greater, or 120 or greater. One example of a GTL has a VI of 129. Typically GTL base fluids have effectively zero sulfur and nitrogen contents, generally less than 5 mg/kg of each of these elements. GTL base stocks are Group III oils, as classified by the American Petroleum Institute (API).

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid (GTL) oils.

The hydraulic fluid may be in the form of a concentrate and/or a fully formulated hydraulic fluid. If the hydraulic fluid is in the form of a concentrate (which may be combined with additional oil to form, in whole or in part, a finished hydraulic fluid), the ratio of the of these additives to the oil of lubricating viscosity and/or to diluent oil include the ranges of 1:99 to 99:1 by weight, or 80:20 to 10:90 by weight.

The hydraulic fluid may be prepared by adding the esterified copolymer to an oil of lubricating viscosity, optionally in the presence of one or more other performance additives.

Performance Additives

Performance additives useful herein may include at least one of detergents, such as neutral and overbased detergents, antiwear agents (e.g., zinc hydrocarbyl(thio)phosphates), antioxidants (including phenolic and aminic antioxidants), pour point depressants, viscosity modifiers (e.g., olefin copolymer such as an ethylene-propylene copolymer), dispersant viscosity modifiers, friction modifiers, foam inhibitors, demulsifiers, extreme pressure agents, and corrosion inhibitors (including metal deactivators).

Since conventional dispersants tend to inhibit demulsibility, the exemplary hydraulic fluid is free or substantially free of dispersants, other that the esterified copolymer described herein, which may have an adverse effect on demulsibility. Substantially free means a total of less than 0.1 wt. %, or less than 0.01 wt. %, or less than 0.001 wt. % of such other dispersants in the hydraulic fluid. The dispersants to be excluded or present only in very minor amounts include nitrogen-containing dispersants (e.g., succinimide dispersants and Mannich dispersants), hydrocarbyl group substituted ashless dispersants, and polyisobutylene dispersants, examples of which are given below.

In one embodiment, the exemplary hydraulic fluid is free or substantially-free of polyacrylates and polymethacrylates. By substantially free it is meant that polyacrylates and polymethacrylates, in total, amount to no more than 0.3 wt. %, or no more than 0.2 wt. %, or no more than 0.1 wt. % of the hydraulic fluid. A polymethacrylate or polyacrylate, as defined herein, is a polymer containing, in total, at least 30 mol. % (e.g., at least 50 mol. % or at least 70 mol. %) acrylate and/or methacrylate units and which has a weight-average molecular weight of at least 1500 (or at least 2000), as determined by light scattering according to ASTM D4001-13, "Standard Test Method for Determination of Weight-Average Molecular Weight of Polymers By Light Scattering, ASTM International, West Conshohocken, Pa., 2013.

In one embodiment, the exemplary hydraulic fluid is free or substantially-free of esterified polyacrylates and esterified polymethacrylates, i.e., polyacrylates and polymethacrylates, as described above having, on average at least one pendent ester group. By substantially free, it is meant that esterified polyacrylates and polymethacrylates, in total, are less than 0.1 wt. %, or less than 0.01 wt. % of the hydraulic fluid.

Exemplary antioxidants useful as oxidation inhibitors include sulfurized olefins, hindered phenols (including hindered phenol esters), diarylamines (such as diphenylamines, e.g., alkylated diphenylamines), phenyl-alpha-naphthylamines, molybdenum compounds (such as molybdenum dithiocarbamates), hydroxyl thioethers, trimethyl polyquinolines (e.g., 1,2-dihydro-2,2,4-trimethylquinoline), and mixtures and derivatives thereof.

The diarylamine may be a phenyl-α-naphthylamine (PANA), an alkylated diphenylamine, an alkylated phenylnapthylamine, or mixture thereof. Example alkylated diphenylamines include di-nonylated diphenylamine, nonyl diphenylamine, octyl diphenylamine, di-octylated diphenylamine, di-decylated diphenylamine, decyl diphenylamine, benzyl diphenylamine and mixtures thereof. In one embodiment the diphenylamine may include nonyl diphenylamine, dinonyl diphenylamine, octyl diphenylamine, dioctyl diphenylamine, or a mixture thereof. In one embodiment the alkylated diphenylamine may include nonyl diphenylamine, or dinonyl diphenylamine. Example alkylated diarylamines include octyl, di-octyl, nonyl, di-nonyl, decyl and di-decyl phenylnapthylamines. In one embodiment, the diphenylamine is alkylated with a benzene and t-butyl substituent.

The hindered phenol antioxidant may contain a secondary butyl and/or a tertiary butyl group as a sterically hindering group. The phenol group may be further substituted with a hydrocarbyl group (such as a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, and 4-dodecyl-2,6-di-tert-butylphenol. In one embodiment the hindered phenol antioxidant may be an ester such as that sold under the trade name Irganox™ L-135 available from BASF GmbH. A more detailed description of suitable ester-containing hindered phenol anti-oxidant chemistry is found in U.S. Pat. No. 6,559,105.

Examples of molybdenum dithiocarbamates, which may be used as an antioxidants, include commercial materials sold under the trade names Molyvan 822®, Molyvan® A, Molyvan® 855 from R. T. Vanderbilt Co., Ltd., and Adeka Sakura-Lube™ S100, S165, S600 and S525, and mixtures thereof. An example of a dithiocarbamate which may be used as an anti-oxidant or anti-wear agent is Vanlube® 7723 from R. T. Vanderbilt Co., Ltd.

The antioxidant may include a substituted hydrocarbyl mono-sulfide represented by the formula:

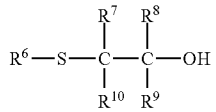

where $R^6$ may be a saturated or unsaturated branched or linear alkyl group with 8 to 20 carbon atoms; $R^7$, $R^8$, $R^9$ and $R^{10}$ are independently hydrogen or alkyl containing 1 to 3 carbon atoms. In some embodiments the substituted hydrocarbyl monosulfides include n-dodecyl-2-hydroxyethyl sulfide, 1-(tert-dodecylthio)-2-propanol, or combinations thereof. In some embodiments the substituted hydrocarbyl monosulfide is 1-(tert-dodecylthio)-2-propanol.

Antioxidant compounds may be used alone or in combination. The antioxidant, where used, may be present at from 0.02 wt. % to 4 wt. % of the hydraulic fluid, such as 0.02 wt. % to 3.0 wt. %, or 0.03 wt. % to 1.5 wt. %.

Exemplary detergents include neutral or overbased, Newtonian or non-Newtonian, basic salts of alkali, alkaline earth and transition metals with one or more of a phenate, a sulfurized phenate, a sulfonate, a carboxylic acid, a phosphorus acid, a mono- and/or a di-thiophosphoric acid, a saligenin, an alkylsalicylate, a salixarate or mixtures thereof. A neutral detergent has a metal:detergent (soap) molar ratio of approximately one. An overbased detergent has a metal: detergent molar ratio exceeding one, i.e. the metal content is more than that necessary to provide for a neutral salt of the detergent. In one embodiment the hydraulic fluid comprises at least one overbased metal-containing detergent with a metal:detergent molar ratio of at least 3. The overbased detergent may have a metal:detergent molar ratio of at least 5, or at least 8, or at least 12. The detergent may be borated with a borating agent such as boric acid, e.g., a borated overbased calcium or magnesium sulfonate detergent, or mixtures thereof.

The detergent, where used, may be present at from 0.001 to 5 wt. % of the hydraulic fluid, such as 0.001 wt. % to 1.5 wt. %, or 0.005 wt. % to 1 wt. %, or 0.01 wt. % to 0.5 wt.

Antiwear agents can include phosphorus compounds such as metal thiophosphates and phosphates, especially those containing zinc, such as zinc dialkyldithiophosphates (ZDDP) and zinc dialkylphosphate, phosphoric acid esters, and salts thereof (e.g., amine salts); phosphites; and phosphorus-containing carboxylic esters, ethers, and amides, such as phosphorylated hydroxy substituted di or tri esters of phosphoric or thiophosphoric acid and amine salts thereof; antiscuffing agents including organic sulfides and polysulfides, such as benzyldisulfide, bis-(chlorobenzyl)disulfide, dibutyl tetrasulfide, di-tertiary butyl polysulfide, di-tert-butylsulfide, sulfurized Diels-Alder adducts, or alkyl sulfenyl N',N-dialkyl dithiocarbamates.

Examples of anti-wear agents include non-ionic phosphorus compounds (typically compounds having phosphorus atoms with an oxidation state of +3 or +5). In one embodiment the amine salt of the phosphorus compound may be ashless, i.e., metal-free (prior to being mixed with other components). Amines suitable for use in the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain 2 to 30 carbon atoms, or 8 to 26, or 10 to 20, or 13 to 19 carbon atoms.

Example primary amines useful in forming amine salts include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups. Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines may be cyclic amines such as piperidine, piperazine and morpholine. Examples of suitable tertiary-aliphatic primary amines include those in which the aliphatic group is an alkyl group containing 2 to 30, or 6 to 26, or 8 to 24 carbon atoms. Tertiary alkyl amines include monoamines such as tert-butylamine, tea-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the phosphorus acid amine salt includes an amine with $C_{11}$ to $C_{14}$ tertiary alkyl primary groups or mixtures thereof, an amine with $C_{14}$ to $C_{18}$ tertiary alkyl primary amines or mixtures thereof, or an amine with $C_{18}$ to $C_{22}$ tertiary alkyl primary amines or mixtures thereof. Mixtures of such amines may also be used. Useful mixtures of amines include a mixture of Primene® 81R, which is itself a mixture of $C_{11}$ to $C_{14}$ tertiary alkyl primary amines, and Primene® JMT, which is a mixture of $C_{18}$ to $C_{22}$ tertiary alkyl primary amines, both available from Rohm & Haas.

In one embodiment oil soluble amine salts of phosphorus compounds include a sulfur-free amine salt of a phosphorus-containing compound may be obtained/obtainable by a process comprising: reacting an amine with either (i) a hydroxy-substituted di-ester of phosphoric acid, or (ii) a phosphorylated hydroxy-substituted di- or tri-ester of phosphoric acid. A more detailed description of compounds of this type is disclosed in U.S. Pat. No. 8,361,941.

In one embodiment the hydrocarbyl amine salt of an alkylphosphoric acid ester is the reaction product of a $C_{14}$ to $C_{18}$ alkylated phosphoric acid with Primene 81R® tertiary alkyl primary amine mixture.

Examples of hydrocarbyl amine salts of dialkyldithiophosphoric acid esters include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or the Primene® 81R mixture, and mixtures thereof.

In one embodiment the dithiophosphoric acid may be reacted with an epoxide or a glycol. This reaction product is further reacted with a phosphorus acid, anhydride, or lower ester. The epoxide includes an aliphatic epoxide or a styrene oxide. Examples of useful epoxides include ethylene oxide, propylene oxide, butene oxide, octene oxide, dodecene oxide, and styrene oxide. In one embodiment the epoxide may be propylene oxide. The glycols may be aliphatic glycols having from 1 to 12, or from 2 to 6, or 2 to 3 carbon atoms. The dithiophosphoric acids, glycols, epoxides, inorganic phosphorus reagents, and methods of reacting the same are described in U.S. Pat. Nos. 3,197,405 and 3,544,465. The resulting acids may then be salted with amines. An example of suitable dithiophosphoric acid is prepared by adding phosphorus pentoxide (about 64 grams) at 58° C. over a period of 45 minutes to 514 grams of hydroxypropyl O,O-di(4-methyl-2-pentyl)phosphorodithioate (prepared by reacting di(4-methyl-2-pentyl)-phosphorodithioic acid with 1.3 moles of propylene oxide at 25° C.). The mixture may be heated at 75° C. for 2.5 hours, mixed with a diatomaceous earth and filtered at 70° C. The filtrate contains 11.8% by weight phosphorus, 15.2% by weight sulfur, and an acid number of 87 (bromophenol blue).

In one embodiment the anti-wear additives may include a zinc dialkyldithiophosphate. In one embodiment, the hydraulic fluid includes zinc dialkyldithiophosphates at 0.05-0.5 wt. %. In other embodiments, the hydraulic fluid is substantially free of (less than 0.02 wt. %), or even completely free of zinc dialkyldithiophosphate.

In one embodiment, the antiwear agent includes a dithiocarbamate antiwear agent as described in U.S. Pat. No. 4,758,362, col. 2, line 35, to col. 6, line 11. When present, the dithiocarbamate antiwear agent may be present at from 0.25 wt. %, 0.3 wt. %, 0.4 wt. % or 0.5 wt. % up to 0.75 wt. %, 0.7 wt. %, 0.6 wt. % or 0.55 wt. % of the hydraulic fluid.

The anti-wear agent, where present, may be 0.001 wt. % to 5 wt. %, or 0.001 wt. % to 2 wt. %, or 0.01 wt. % to 1.0 wt. % of the hydraulic fluid.

Exemplary pour point depressants include esters of maleic anhydride-styrene copolymers, polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof. The pour point depressant, where used, may be present at from 0.005-0.3 wt. % of the hydraulic fluid. In one embodiment, polymethacrylate pour point depressants are present at 0.005-0.3 wt. % of the hydraulic fluid.

Exemplary antifoam agents, also known as foam inhibitors, include organic silicones and non-silicon foam inhibitors. Examples of organic silicones include dimethyl silicone and polysiloxanes. Examples of non-silicon foam inhibitors include copolymers of ethyl acrylate and 2-ethylhexylacrylate, copolymers of ethyl acrylate, 2-ethylhexylacrylate and vinyl acetate, polyethers, polyacrylates and mixtures thereof. In some embodiments the anti-foam is a polyacrylate. Antifoam agents may be present in the composition from 0.001 wt. % to 0.012 wt. %, or 0.001 wt. % to 0.004 wt. %, or 0.001 wt. % to 0.003 wt. %.

Exemplary demulsifiers include derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include polyethylene glycols, polyethylene oxides, polypropylene oxides, (ethylene oxide-propylene oxide) polymers and mixtures thereof. In some embodiments the demulsifiers is a polyether. Demulsifiers may be present in the composition at from 0.002 wt. % to 0.012 wt. %.

Exemplary extreme pressure agents include compounds containing sulfur and/or phosphorus. Examples of extreme pressure agents include polysulfides, sulfurized olefins, thiadiazoles, and mixtures thereof.

Examples of thiadiazoles include dimercaptothiadiazole, such as 2,5-dimercapto-1,3,4-thiadiazole, 3,5-dimercapto-1,2,4-thiadiazole, 4-5-dimercapto-1,2,3-thiadiazole, and oligomers thereof, hydrocarbyl-substituted 2,5-dimercapto-1,3,4-thiadiazoles, hydrocarbylthio-substituted 2,5-dimercapto-1,3,4-thiadiazoles, and oligomers thereof. The oligomers of hydrocarbyl-substituted 2,5-dimercapto-1,3,4-thiadiazole may form by forming a sulfur-sulfur bond between 2,5-dimercapto-1,3,4-thiadiazole units to form oligomers of two or more such thiadiazole units. The number of carbon atoms on the hydrocarbyl-substituent group may be from 1 to 30, 2 to 25, 4 to 20, 6 to 16, or 8 to 10. The 2,5-dimercapto-1,3,4-thiadiazole may be 2,5-dioctyl dithio-1,3,4-thiadiazole, or 2,5-dinonyl dithio-1,3,4-thiadiazole.

The polysulfide may include a sulfurized organic polysulfide from oils, fatty acids or esters, olefins, or polyolefins.

Oils which may be sulfurized include natural or synthetic oils such as mineral oils, lard oil, carboxylate esters derived from aliphatic alcohols and fatty acids or aliphatic carboxylic acids (e.g., myristyl oleate and oleyl oleate), and synthetic unsaturated esters or glycerides.

Fatty acids include those that contain 8 to 30, or 12 to 24 carbon atoms. Examples of fatty acids include oleic, linoleic, linolenic, and tall oil. Sulfurized fatty acid esters prepared from mixed unsaturated fatty acid esters such as are obtained from animal fats and vegetable oils, including tall oil, linseed oil, soybean oil, rapeseed oil, and fish oil.

Polysulfides include olefins derived from a wide range of alkenes. The alkenes may have one or more double bonds. The olefin, in one embodiment, contains 3 to 30 carbon atoms. In other embodiments, the olefin contains 3 to 16, or 3 to 9 carbon atoms. In one embodiment the sulfurized olefin includes an olefin derived from propylene, isobutylene, pentene or mixtures thereof. In one embodiment the polysulfide includes dibutyl tetrasulfide, sulfurized methyl ester of oleic acid, sulfurized alkylphenol, sulfurized dipentene, sulfurized dicyclopentadiene, sulfurized terpene, or a sulfurized Diels-Alder adduct.

The extreme pressure agent, where present, may be 0.005 wt. % to 3 wt. %, or 0.005 wt. % to 2 wt. %, or 0.01 wt. % to 1.0 wt. % of the hydraulic fluid.

Exemplary viscosity modifiers (often referred to as viscosity index improvers) suitable for use herein include polymeric materials including styrene-butadiene rubbers, olefin copolymers, hydrogenated styrene-isoprene polymers, hydrogenated radical isoprene polymers, poly(meth) acrylic acid esters, polyalkylstyrenes, hydrogenated alkenylaryl conjugated-diene copolymers, esters of maleic anhydride-styrene copolymers, and mixtures thereof. In some embodiments the viscosity modifier is a poly(meth) acrylic acid ester, an olefin copolymer, or mixture thereof.

The viscosity modifier, where present, may be 0.1 wt. % to 10 wt. %, or 0.5 wt. % to 8 wt. %, or 1 wt. % to 6 wt. % of the hydraulic fluid.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

As used herein the term "fatty alkyl" or "fatty" in relation to friction modifiers means a carbon chain having 10 to 22 carbon atoms, typically a straight carbon chain. Alternatively, the fatty alkyl may be a mono branched alkyl group, with branching typically at the β-position. Examples of mono branched alkyl groups include 2-ethylhexyl, 2-propylheptyl, and 2-octyldodecyl.

The friction modifier may be present at 0.01 wt. % to 3 wt. %, or 0.02 wt. % to 2 wt. %, or 0.05 wt. % to 1 wt. %, of the of the hydraulic fluid.

Exemplary corrosion inhibitors include hydrocarbyl amine salts of alkylphosphoric acid, hydrocarbyl amine salts of dialkyldithiophosphoric acid, hydrocarbyl amine salts of hydrocarbyl aryl sulfonic acid, fatty carboxylic acids or esters thereof, an ester of a nitrogen-containing carboxylic acid (such as octylamine octanoate), an ammonium sulfonate, an imidazoline, alkylated succinic acid derivatives reacted with alcohols or ethers, or condensation product of dodecenyl succinic acid or anhydride and a fatty acid such as oleic acid with a polyamine, and mixtures thereof.

Suitable hydrocarbyl amine salts of alkylphosphoric acid may be represented by the following formula:

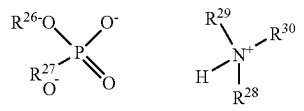

where $R^{26}$ and $R^{27}$ are independently hydrogen, alkyl chains or hydrocarbyl, e.g., at least one of $R^{26}$ and $R^{27}$ is hydrocarbyl. $R^{26}$ and $R^{27}$ contain 4 to 30, or 8 to 25, or 10 to 20, or 13 to 19 carbon atoms. $R^{28}$, $R^{29}$ and $R^{30}$ are independently hydrogen, alkyl branched or linear alkyl chains with 1 to 30, or 4 to 24, or 6 to 20, or 10 to 16 carbon atoms. $R^{28}$, $R^{29}$ and $R^{30}$ are independently hydrogen, alkyl branched or linear alkyl chains, or at least one, or two of $R^{28}$, $R^{29}$ and $R^{30}$ are hydrogen.

Examples of alkyl groups suitable for $R^{28}$, $R^{29}$ and $R^{30}$ include butyl, sec butyl, isobutyl, tert-butyl, pentyl, n-hexyl, sec hexyl, n-octyl, 2-ethyl, hexyl, decyl, undecyl, dodecyl, tridecyl, tetradecyl, pentadecyl, hexadecyl, heptadecyl, octadecyl, octadecenyl, nonadecyl, eicosyl or mixtures thereof.

In one embodiment the hydrocarbyl amine salt of an alkylphosphoric acid is the reaction product of a $C_{14}$ to $C_{18}$ alkylated phosphoric acid with a mixture of $C_{11}$ to $C_{14}$ tertiary alkyl primary amines, such as a mixture sold under the trade name Primene® 81R by Rohm & Haas.

Example hydrocarbyl amine salts of dialkyldithiophosphoric acid may be a reaction product of heptyl or octyl or nonyl dithiophosphoric acids with ethylene diamine, morpholine or Primene® 81R, or a mixture thereof.

The hydrocarbyl amine salts of hydrocarbyl aryl sulfonic acid may include ethylene diamine salt of dinonyl naphthalene sulfonic acid.

Examples of suitable fatty carboxylic acids or esters thereof include glycerol monooleate and oleic acid. An example of a suitable ester of a nitrogen-containing carboxylic acid includes oleyl sarcosine.

Example metal deactivators include derivatives of benzotriazoles (e.g., tolyltriazole), thiadiazoles, such as dimercaptothiadiazole and its derivatives, 1,2,4-triazoles, benzimidazoles, 2-alkyldithiobenzimidazoles, 2-alkyldithiobenzothiazoles, 1-amino-2-propanol, octylamine octanoate, condensation products of dodecenyl succinic acid or anhydride and/or a fatty acid such as oleic acid with a polyamine.

The corrosion inhibitor, where used, may be present at from 0.001-1.5 wt. % of the hydraulic fluid, such as 0.02 wt. % to 0.2 wt. %, from 0.03 wt. % to 0.15 wt. %, from 0.04 wt. % to 0.12 wt. %, or from 0.05 wt. % to 0.1 wt. %. The corrosion inhibitors may be used alone or in mixtures thereof.

In one embodiment, the exemplary hydraulic fluid or lubricant concentrate is free of sulfurized olefins and amine phosphates. By "free," it is meant that these ingredients, individually or in combination, amount to less than 0.001% of the hydraulic fluid.

Dispersants other than the exemplary esterified copolymer, which are desirably present only at low levels (a total of less than 0.1 wt. %, or less than 0.01 wt. %, or less than 0.001 wt. %), if at all, include ashless-type dispersants. Ashless-type dispersants as so described because, prior to mixing in a lubricating oil composition, they do not contain ash-forming metals and they do not normally contribute any ash forming metals when added to a lubricant and polymeric dispersants. Ashless type dispersants are characterized by a functional group attached to a relatively high molecular weight hydrocarbon backbone. The polymeric hydrocarbon backbone may have a weight average molecular weight ranging from 750 to 1500 Daltons. Exemplary functional groups include amines, alcohols, amides, and ester polar moieties which are attached to the polymer backbone, often via a bridging group. Examples include succinimides, phosphonates, polyisobutylene-based dispersants, acylated polyalkylene polyamines, and Mannich bases. Mannich bases are the reaction products of alkyl phenols with aldehydes (especially formaldehyde) and amines (especially polyalkylene polyamines). The alkyl group typically contains at least 30 carbon atoms.

Example dispersants of this type include Mannich dispersants, described in U.S. Pat. Nos. 3,697,574 and 3,736,357; ashless succinimide dispersants described in U.S. Pat. Nos. 4,234,435 and 4,636,322; amine dispersants described in U.S. Pat. Nos. 3,219,666, 3,565,804, and 5,633,326; Koch dispersants, described in U.S. Pat. Nos. 5,936,041, 5,643,859, and 5,627,259, and polyalkylene succinimide dispersants, described in U.S. Pat. Nos. 5,851,965, 5,853,434, and 5,792,729. Exemplary succinimide dispersants include N-substituted long chain alkenyl succinimides as well as post-treated versions thereof. U.S. Pat. Nos. 3,215,707; 3,231,587; 3,515,669; 3,579,450; 3,912,764; 4,605,808; 4,152,499; 5,071,919; 5,137,980; 5,286,823; 5,254,649 describe methods for forming such dispersants and their components. Polyisobutylene-based dispersants can be derived from polyisobutylene, an amine and zinc oxide to form a polyisobutylene succinimide complex with zinc. Acylated polyalkylene polyamines are described in U.S. Pat. No. 5,330,667.

Post-treated dispersants include those further treated by reaction with materials such as urea, boron, thiourea, dimercaptothiadiazoles, carbon disulfide, aldehydes, ketones, carboxylic acids, hydrocarbon-substituted succinic anhydrides, nitriles, epoxides and phosphorus compounds. Such dispersants can be produced by reaction of a $C_3$-$C_6$ polyalkylene (e.g., polypropylene, polyisobutylene, polypentylene, polyheptylene) or derivative thereof (e.g., a chlorinated derivative) with a mono- or α,β unsaturated-dicarboxylic acid or anhydride thereof (such as maleic anhydride or succinic anhydride) to produce an acylated $C_3$-$C_6$ polyalkylene compound, which is reacted with an amine, such as a primary amine or a polyamine, such as a polyethylene amine, to produce the dispersant.

Method of Making the Hydraulic Fluid

The esterified copolymer can be formed by a method which includes:

(1) reacting (i) a vinyl monomer and (ii) a carboxylic acid monomer, such as an α,β-ethylenically unsaturated dicarboxylic acid or derivative thereof, to form a copolymer backbone, wherein the carboxylic acid monomer optionally has ester groups, (2) optionally, esterifying the copolymer backbone of step (1) to form an esterified copolymer, and (3) reacting the copolymer of step (1) or (2) with an nitrogen-containing compound in an amount to provide an esterified copolymer with at least 0.01 wt. % nitrogen; and whereby the resulting copolymer is esterified in at least one of (1), (2), and (3).

The esterified copolymer is combined with an oil of lubricating viscosity (or mixture of such oils) and optionally one or more performance additives to form the hydraulic fluid.

1. Formation of the Copolymer Backbone

The copolymer backbone of the esterified copolymer may optionally be prepared in the presence of a free radical initiator, solvent, or mixtures thereof. It will be appreciated that altering the amount of initiator can alter the number average molecular weight and other properties of the exemplary copolymer.

The copolymer backbone may be prepared by reacting the carboxylic acid monomer with the vinyl monomer.

The solvent can be a liquid organic diluent. Generally, the solvent has as a boiling point that is high enough to provide the required reaction temperature. Illustrative diluents include toluene, t-butyl benzene, benzene, xylene, chlorobenzene, various petroleum fractions boiling above 125° C., and mixtures thereof.

The free radical initiator can include one or more peroxy compounds, such as peroxides, hydroperoxides, and azo compounds which decompose thermally to provide free radicals. Other suitable examples are described in J. Brandrup and E. H. Immergut, Editor, "Polymer Handbook", 2nd edition, John Wiley and Sons, New York (1975), pages II-1 to II-40. Examples of a free radical initiator include those derived from a free radical-generating reagent, and examples include benzoyl peroxide, t-butyl perbenzoate, t-butyl metachloroperbenzoate, benzophenone, t-butyl peroxide, sec-butylperoxydicarbonate, azobisisobutyronitrile, t-butyl peroxide, t-butyl hydroperoxide, t-amyl peroxide, cumyl peroxide, t-butyl peroctoate, t-butyl-m-chloroperbenzoate, azobisisovaleronitrile, and mixtures thereof. In one embodiment, the free radical generating reagent is t-butyl peroxide, t-butyl hydroperoxide, t-amyl peroxide, cumyl peroxide, t-butyl peroctoate, t-butyl-m-ch loroperbenzoate, azobisisovaleronitrile or mixtures thereof. Commercially available free radical initiators include classes of compound sold under the trademark Trigonox®-21 from Akzo Nobel.

An exemplary backbone polymer can be formed as follows: styrene is reacted with maleic anhydride in the presence of radical initiator and optionally in the presence of solvent. A solvent such as toluene can be used to lower backbone length by diluting the monomer concentration and through chain transfer to the benzylic protons.

Scheme 1 shows an example where the vinyl aromatic compound is styrene, the initiator is benzoyl peroxide (BZP), and the solvent is toluene.

Scheme 1

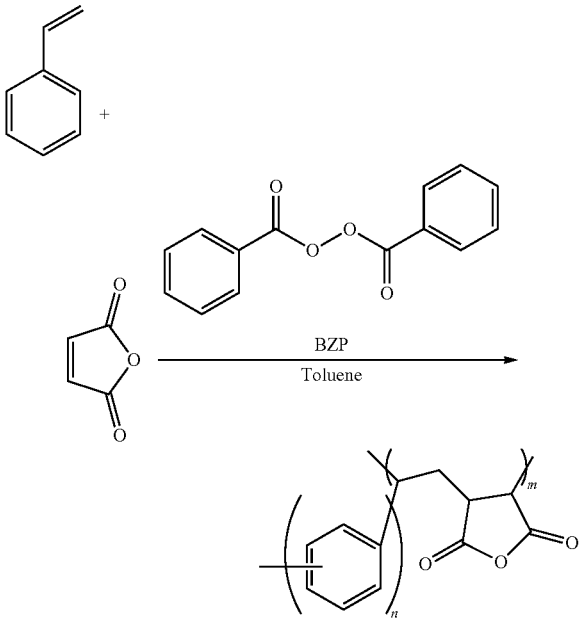

where n and m are independently at least 1, such as an integer from 1 to 10, or from 1 to 5, or from 1 to 3 in each segment of the copolymer (denoted by the two asterisks). As will be appreciated, the resulting backbone copolymer can have random variation of n and m. In general, n=1.

The polymerization process is sensitive to initiator amount, temperature and actives level, all of which can impact the final molecular weight. The reaction may be carried out at 80-120° C., such as 100-110° C.

2. Esterification of the Copolymer Backbone

Esterification (or transesterification, when the copolymer backbone already contains ester groups and those of a different type are desired) of the exemplary copolymer backbone can be accomplished by heating any of the copolymers described above and one or more desired alcohols and/or alkoxylates under conditions typical for effecting esterification. Such conditions include, for example, a temperature of at least 80° C., such as up to 150° C. or higher, provided that the temperature is maintained below the lowest decomposition temperature of any component of the reaction mixture or products thereof. Water or lower alcohol is normally removed as the esterification proceeds. These conditions may optionally include the use of a substantially inert, normally liquid, organic solvent or diluent, such as mineral oil, toluene, benzene, xylene, or the like, and an esterification catalyst, such as one or more of toluene sulfonic acid, sulfuric acid, aluminum chloride, boron trifluoride-triethylamine, methane sulfonic acid, trifluoromethanesulfonic acid, hydrochloric acid, ammonium sulfate, and phosphoric acid. Further details of conducting the esterification can be found in U.S. Pat. No. 6,544,935, at column 11.

In one embodiment, at least 2%, or at least 5%, or in certain embodiments 10% to 20%, of the carboxy functions of the copolymer remain un-converted to ester groups. Most of these will subsequently be converted to nitrogen-containing groups. An excess of alcohols and/or alkoxylates over the stoichiometric requirement for complete esterification of the carboxy functions may be used in the esterification process provided the ester content of the polymer remains in an appropriate range, e.g., within the 80 to 85% range. The excess of alcohols and alkoxylates or unreacted alcohols and alkoxylates need not be removed as such alcohols and alkoxylates can serve, for example, as diluent or solvent in the exemplary hydraulic fluid. Similarly, optional reaction media, e.g., toluene, need not be removed as they can similarly serve as diluent or solvent in the hydraulic fluid. In other embodiments, unreacted alcohols, alkoxylates and diluents are removed by well-known techniques, such as distillation.

Esterification solubilizes the copolymer in oil and also improves the low temperature viscosity and improves the viscosity index.

3. Formation of Nitrogen-Containing Groups on the Copolymer Backbone

The nitrogen-containing compound may be directly reacted onto the copolymer backbone by grafting of the amine, or other nitrogen-containing functional group, onto the copolymer backbone either (i) in a solution using a solvent, or (ii) under reactive extrusion conditions in the presence or absence of solvent.

The reaction may be carried out in a solvent, such as an organic solvent such as benzene, t-butyl benzene, toluene, xylene, hexane, or a combination thereof. The reaction may be carried out at an elevated temperature in the range of 100° C. to 250° C. or 120° C. to 230° C., or 160° C. to 200° C., e.g., above 160° C., in a solvent, such as a mineral lubricating oil solution containing, e.g., 1 to 50, or 5 to 40 wt. %, based on the initial total oil solution of the copolymer and optionally under an inert environment.

By way of example, Scheme 2 exemplifies the esterification of the product of Scheme 1 with exemplary alcohols and consumption of residual anhydride groups following esterification by imidization with aminopropylmorpholine (APLM).

Scheme 2

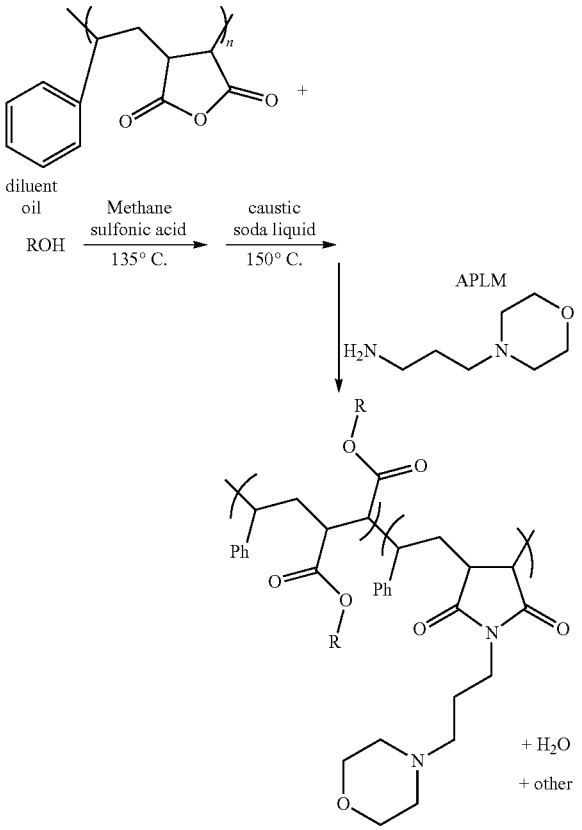

Esterified copolymer

The diluent oil may be, for example, a Group V base oil.

Caustic soda liquid (50% aqueous sodium hydroxide solution) is added to neutralize any remaining acid catalyst.

ROH can be a mixture of alcohols, such as a mixture of 0-5 wt. % $C_4$, 30-50 wt. % $C_{8-11}$, 30-50 wt. % $C_{12-14}$, and 0-2 wt. % $C_{12-18}$ alcohols.

In one embodiment, the amine can have more than one nitrogen and can be selected from aliphatic amines and aromatic amines such that the R group attached to the amine that reacts with the carboxylic acid monomer contains at least one nitrogen atom, optionally substituted with hydrocarbyl groups. The hydrocarbyl groups can be selected from aliphatic, aromatic, cyclic, and acyclic hydrocarbyl groups. As the amine, one or more of the following may be used: 1-(2-amino-ethyl)-imidazolidin-2-one, 4-(3-aminopropyl) morpholine, 3-(dimethylamino)-1-propylamine, N-phenyl-p-phenylenediamine, N-(3-aminopropyl)-2-pyrrolidinone, aminoethyl acetamide, β-alanine methyl ester, and 1-(3-aminopropyl) imidazole.

In one embodiment, the esterified copolymer includes a maleic anhydride/styrene alternating copolymer backbone that is esterified with a mixture of alcohols having from 4 to 18 carbon atoms and further reacted with 1-2 wt. %, expressed by weight of the esterified copolymer (e.g., 1.2-1.8 wt. %), of a nitrogen compound such as aminopropylmorpholine.

Exemplary hydraulic fluids may have a formulation as defined in TABLE 1. All additives are expressed on an oil-free basis.

TABLE 1

Example Hydraulic Lubricant compositions

| Additive | Embodiments (wt. %) A | B | C |
|---|---|---|---|
| Exemplary esterified copolymer | 2 to 12 | 2 to 8 | 2 to 6 |
| Antioxidant | 0 to 4.0 | 0.02 to 3.0 | 0.03 to 1.5 |
| Dispersant | 0 to 0.01 | 0 to 0.01 | 0 to 0.001 |
| Detergent | 0 to 5.0 | 0.001 to 1.5 | 0.005 to 1.0 |
| Anti-wear Agent | 0 to 5.0 | 0.001 to 2 | 0.1 to 1.0 |
| Friction Modifier | 0 to 3.0 | 0.02 to 2 | 0.05 to 1.0 |
| Corrosion inhibitor | 0 to 0.3 | 0.04 to 0.2 | 0.05 to 0.15 |
| Extreme Pressure Agent | 0 to 3.0 | 0.005 to 2 | 0.01 to 1.0 |
| Any Other Performance Additive (antifoam, demulsifier, pour point depressant, etc.) | 0 to 1.3 | 0.0008 to 0.5 | 0.001 to 0.4 |
| Oil of Lubricating Viscosity | Balance to 100% | Balance to 100% | Balance to 100% |

Specific examples of hydraulic lubricating compositions include those summarized in TABLE 2:

TABLE 2

Hydraulic Lubricant compositions

| Additive | Embodiments (wt. %) D | E | F |
|---|---|---|---|
| Exemplary esterified copolymer | 2 | 2.5 | 3.0 |
| Antioxidant-aminic/phenolic | 0.4 | 0.4 | 0.4 |
| Calcium Sulfonate Detergent | 0.2 | 0.2 | 0.2 |
| Zinc dialkyl dithiophosphate | 0.3 | 0.15 | 0 |
| Triazole Metal Deactivator | 0.005 | 0.005 | 0.005 |
| Any Other Performance Additive (antifoam/demulsifier/pour point depressant)(e.g., polymethacrylate blend) | 0.01 | 0.01 | 0.01 |
| Oil of Lubricating Viscosity | Balance to 100% | Balance to 100% | Balance to 100% |

Method of Using the Hydraulic Fluid

Hydraulic systems rely on a hydraulic fluid under pressure to create motion in machine components. Pumps are used to create the combination of flow and pressure in hydraulic systems. The exemplary hydraulic fluid is useful in such systems to provide the pressurized fluid. While the primary purpose of a hydraulic fluid is to transmit energy (power) from the source (pump) to the end use (motor, cylinder, etc.), the hydraulic fluid also helps to minimize wear, reduce friction, provide cooling, inhibit corrosion, and minimize deposits, thereby extending the lifetime and efficiency of the system. The esterified copolymer may be useful in providing improved deposit and varnish control of a hydraulic system while maintaining the demulsibility of the hydraulic fluid.

In accordance with one aspect of the exemplary embodiment, the hydraulic fluid is for use in a hydraulic system, turbine system or other circulating oil system. The hydraulic system may be a device or apparatus in which the hydraulic fluid transmits energy to different parts of the system by hydraulic force. A turbine lubricant is typically used to lubricate the gears or other moving parts of a turbine (or turbine system), such as a steam turbine or a gas turbine. A circulating oil is typically used to distribute heat to or through a device or apparatus through which it is circulated.

In accordance with one aspect of the exemplary embodiment, a method for providing reduced sludge formation in a hydraulic system may include supplying the exemplary hydraulic fluid to the hydraulic system. If the oil of lubricating viscosity is already in the hydraulic system, this may include adding the exemplary esterified copolymer to the oil already present, optionally as a concentrate containing a smaller proportion of oil (greater proportion of the esterified copolymer) than in the hydraulic fluid described above.

In accordance with one aspect of the exemplary embodiment, a method of lubricating a circulating oil system includes supplying to the circulating oil system a hydraulic fluid as disclosed herein.

The exemplary dispersant maleic anhydride-styrene ester copolymer is capable of imparting deposit and varnish control to hydraulic lubricants as well as providing good water demulsification properties. The combination of water demulsification and deposit control is higher than for industrial hydraulic fluids formulated with dispersant polyalkyl (meth)acrylates.

The hydraulic fluid can be used with a variety pump designs, such as piston pumps, vane pumps, and gear pumps.

Piston Pumps generally operate under hydrodynamic lubrication. Under ideal conditions, there is no metal-to-metal contact; therefore, antiwear additives can be omitted for such systems, although a thermally stable antiwear agent, such as zinc dithiophosphate (ZDP) and/or those based on sulfur-phosphorus may be employed.

Vane pumps operate under boundary lubrication. Because of the continuous metal-to-metal contact, the hydraulic fluid desirably includes an antiwear agent to minimize wear. Fluid cleanliness is particularly important for vane pump operation.

Gear pumps operate under full film (hydrodynamic) or mixed film lubrication. Typically, gear pumps operate under mild to medium loads with little or no metal-to-metal contact between the drive and idler gears. Gear pumps are not as contamination sensitive as vane and piston pumps.

The performance additives which are used in the hydraulic fluid may impart specific properties, such as kinematic viscosity, viscosity index, wear protection capability, oxidation, thermal and hydrolytic stability, antifoam and air separation characteristics, demulsibility, rust protection, seal compatibility, and filterability. Additionally, the hydraulic fluid additives may be selected to meet and exceed the requirements of industry manufacturers' specifications, including, for example, one or more of Parker Denison HF-O, HF-1, HF-2; Eaton Brochure 03-401-2010; Bosch Rexroth ROE 90240; Fives Cincinnati P-68, P-69, P-70; General Motors (LS2) LH-03-1, LH-04-1, LH-06-1; DIN 51524, Part 2; ASTM 06158; ISO 11158; and US Steel 127.

Without intending to limit the scope of the exemplary embodiment, the following examples illustrate preparation of illustrative polymers and results obtained.

EXAMPLES

In the following:

APLM=Aminopropylmorpholine (obtained from Huntsman).

DMAPA=Dimethylaminopropylamine (obtained from Brenntag).

Neodol 91™=a blend of $C_9$, $C_{10}$, and $C_{11}$ high purity primary alcohols obtained from Shell.

Weight average molecular weight (Mw) is obtained by GPC with Polystyrene Standard/THF solvent and expressed on an oil-free basis.

Percentage nitrogen (% N) is obtained by ASTM 5291-10 (2015), Standard Test Methods for Instrumental Determination of Carbon, Hydrogen, and Nitrogen in Petroleum Products and Lubricants, ASTM International, West Conshohocken, Pa., 2015.

Example 1: Preparation of a Maleic Anhydride Copolymer Esterified with a Mixture of Linear Alcohols and Imidized with Aminopropylmorpholine a) Preparation of Maleic Anhydride-Styrene Copolymer A 4-neck 5-L round bottom flask fitted with a thermocouple, nitrogen inlet, two addition funnels, glass stir rod and water-cooled condenser is charged with maleic anhydride (MAA) (204.16 g, 2.08 mol) and toluene (2867 g; 93% of total toluene charge). The contents are heated to 104° C. under 1 SCFH $N_2$. The heating proceeds without stirring until ~70° C. to allow the MAA to melt/dissolve.

Styrene (216.6 g, 2.08 mol) is charged to one of the addition funnels. A mixture of BZP-75 (75% aqueous solution of benzoyl peroxide) (2.46 g, 0.0076 mol) and toluene (216 g, 7% of toluene) is charged to the second addition funnel. Once the temperature of the flask reaches 104° C., the styrene and initiator solution are fed to the reaction flask simultaneously in a dropwise fashion over 90 minutes. A white, chalky resin begins to precipitate from the reaction solution. Upon completion of the feeds, the reaction is held at 104° C. for an additional 4 hours.

The expected reaction is shown in Scheme 1, above.

b) Esterification of Maleic Anhydride-Styrene Copolymer

A 4-neck 5-L round bottom flask fitted with a thermocouple, nitrogen inlet, glass stir rod and Dean-Stark trap capped with a water-cooled condenser is charged with the reaction mixture containing the copolymer (3486 g of the slurry from step α, containing approx. 12% actives: ~218 g of copolymer, 4.14 mol), Neodol 91, obtained from Shell (328.6 g, 2.05 mol), Alfol 1214, obtained from Sasol (a mixture of linear alcohols, predominantly in the $C_{12}$-$C_{14}$ range) (4.06.2 g, 2.05 mol), Alfol 1218, obtained from Sasol (a mixture of linear alcohols, predominantly in the $C_{12}$-$C_{18}$ range) (18.0 g, 0.08 mol), and a Group V diluent oil (300.1 g). (It is to be noted that a part of the diluent oil can be held back to allow for adjustments in the final viscosity later.) The flask is heated to 125° C. under 0.5 SCFH $N_2$ with removal of toluene by distillation. The reaction is held at 125° C. for 1 h to allow the contents to become oil soluble. The reaction temperature is then increased to 135° C. with removal of additional toluene by distillation. Methane sulfonic acid (21.3 g, 0.16 mol) is charged to the reaction (slowly, to avoid foaming). The reaction is held at a steady rate of reflux for 16 h (overnight). During this time, water is collected in the Dean-Stark trap.

1-Butanol (16.2 g, 4% of FOH-1214 alcohol charge) is charged to the reaction flask slowly over 10 minutes. The reaction is held for 2 h.

Caustic soda liquid (8.4 g) is added dropwise to the flask to neutralize remaining Methane sulfonic acid. The target differential acid number (DAN) is approximately 4 mg KOH/g to indicate the reaction is complete.

To monitor the esterification reaction, the acid number is measured using 0.1M KOH with phenolphthalein and bromophenol blue indicators to measure total acid numbers (TAN) and catalyst acid numbers (CAN), respectively. These are then used to calculate the differential acid number (DAN=TAN−CAN), which is the residual carboxylic acid on the copolymer.

After the reaction is held at 135° C. for 3 h, bromophenol blue indicator is used to determine if any acid catalyst remained un-neutralized. The solution turns blue on addition of the indicator, confirming the HSOM has been completely neutralized.

c) Imidization of the Esterified Maleic Anhydride-Styrene Copolymer with Aminopropylmorpholine (APLM)

The reaction product of b) is heated to 150° C. and APLM (16.0 g, 0.11 mol) is charged with 100 g of toluene dropwise over 30 minutes. The reaction is held at 150° C. for 2 h. Vacuum is applied at 150° C. and the pressure slowly reduced to 0.5 mm-Hg, then held for 2 h to remove toluene. Once stripping is complete, the vacuum is broken with nitrogen.

Steps b) and c) are illustrated in Reaction Scheme 2, above.

The yield is 86.5% of theoretical. The average number of carbons on each ester group is 13.

Examples B-D are prepared in a similar manner to Example A, but using different combinations of reactants, as shown in Table 3. Polymers E-G are included for reference. Example H is a multigrade hydraulic oil containing a polymer. Those containing non-dispersant polyalkyl(meth) acrylates such as Examples E and G are typically poor on deposit control when used in either Group II or Group I base oil.

% nitrogen is measured according to ASTM D5291-10, "Standard Test Methods for Instrumental Determination of Carbon, Hydrogen, and Nitrogen in Petroleum Products and Lubricants," ASTM International, West Conshohocken, Pa., 2015.

TABLE 3

Polymer Examples

| Example | Polymer | Amine | Mw | % N | ROH Composition |
|---|---|---|---|---|---|
| A | Maleic Anhydride-Styrene | APLM | 50542 | 0.24 | C4; C8-11; C12-14; C12-18 |
| B | Maleic Anhydride-Styrene | APLM | 39000 | 0.23 | C4; C8-11; C12-14; C12-18 |
| C | Maleic Anhydride-Styrene | APLM | 29000 | 0.27 | C4; C8-11; C12-14; C12-18 |
| D | Maleic Anhydride-Styrene | DMAPA | 45129 | 0.44 | C4; C8-11; C12-14; C12-18 |
| E | Polyalkyl(meth) acrylate | None | 31000 | 0 | C1; C12-15 |
| F | Polyalkyl(meth) acrylate | DMAPA | 34000 | 0.3 | C8; C12-15 |
| G | Polyalkyl(meth) acrylate | None | | 0 | |
| H | Commercial Product | | | Unknown | |

TABLE 4 shows example hydraulic fluids prepared. (Example 1 is Example H above).

TABLE 4

Hydraulic fluids

| | Example | | | | | | | | | |
|---|---|---|---|---|---|---|---|---|---|---|
| Base oil | 2 | 3 | 4 | 5 | 6 | 7 | 8 | 9 | 10 | 11 |
| Group II 110N | | | | | | | | | | 45.02 |
| Group II 200N | | | | | | | | | | 45.02 |
| Group I 150N | | 90.85 | | | | | | | 100 | |
| Group II 100N | 90.85 | | 21.37 | 21.3 | 21.5 | 21.4 | 65.8 | 21.5 | | |
| Group II 220N | | | 72.37 | 72.1 | 72.9 | 72 | 23.2 | 72.9 | | |
| Ex. A Polymer | | | 3.97 | 3.97 | | 4.4 | | | 5.5 | 6.45 |
| Ex. B Polymer | | | | | | | 4 | | | |
| Ex. D Polymer | | | | | | | | 3.4 | | |
| Ex. E Polymer | 6.3 | 6.3 | | | | | | | | |
| Ex. F Polymer | | | | | 3.6 | | | | | |
| zinc-based antiwear composition (with some diluent oil) | 0.85 | 0.85 | 0.85 | | 0.85 | 0.85 | 0.85 | 0.85 | 0.85 | |
| zinc-based antiwear composition with polyisobutylene succinimide dispersant (with some diluent oil) | | | | 1.1 | | | | | | |
| anti-wear agent | | | | | | | | | | 0.75 |
| antioxidant | | | | | | | | | | 0.79 |
| corrosion inhibitor | | | | | | | | | | 0.0085 |
| mineral oil | | | | | | | | | | 0.01 |
| polymethacrylate blend (pour point depressant) | 0.1 | 0.1 | 0.1 | 0.1 | 0.1 | | | 0.1 | | |

EVALUATION OF POLYMER EXAMPLES

Panel coker deposits are evaluated as follows. A 4.210 g sample of hydraulic fluid is heated in a 105° C. coker sump and is splashed onto an aluminum panel maintained at 325° C. for 120 seconds, allowed to bake for 45 seconds, repeatedly, for 4 hours. The aluminum plates are analyzed using image analysis techniques to obtain a universal rating. The rating score, measured in % unit rating, is based on 100% being a clean plate and 0% being a plate wholly covered in deposit. Higher values are better.

Kinematic viscosity is determined at 100° C. (KV_100) and at 40° C. (KV_40) according to ASTM D2270-10e1, "Standard Practice for Calculating Viscosity Index From Kinematic Viscosity at 40 and 100° C.," ASTM International, West Conshohocken, Pa., 2010 (which references ASTM D445).

The viscosity index (VI) is determined according to ASTM D2270-10e1, "Standard Practice for Calculating Viscosity Index From Kinematic Viscosity at 40 and 100° C.," ASTM International, West Conshohocken, Pa., 2010.

Water Demulsability Performance: is measured for Examples 6-11 according to ASTM D1401-12e1, "Standard Test Method for Water Separability of Petroleum Oils and Synthetic Fluids," ASTM International, West Conshohocken, Pa., 2012, with the bath operated at 54° C. The higher the amount of emulsion, in mL the poorer the demulsibility. Table 5 shows results obtained.

TABLE 5

Results for Hydraulic fluids

| Example | 1 | 2 | 3 | 4 | 5 | 6 |
|---|---|---|---|---|---|---|
| polymer | Ex. H | Ex. E | Ex. E | Ex. A | Ex. A | Ex. F |
| KV_100 | 7.96 | 6.56 | 8.6 | 8.01 | 8.06 | 7.5 |
| KV_40 | 47.07 | 31.32 | 47.78 | 46.4 | 46.76 | 44.74 |
| VI | 140 | 171 | 150 | 145 | 145 | 134 |
| Coker % | 35 | 30 | 23 | 70 | 54 | n/a |
| N, in gms. | n/a | n/a | n/a | n/a | n/a | 0.01 |
| emulsion, mL | n/a | n/a | n/a | n/a | n/a | 61 |

| Example | 7 | 8 | 9 | 10 | 11 |
|---|---|---|---|---|---|
| polymer | Ex. A | Ex. B | Ex. D | Ex. A | Ex. A |
| KV_100 | 8.2 | 6.21 | 7.82 | 8.26 | 8.62 |
| KV_40 | 48.09 | 32.66 | 45.82 | 48.1 | 47.99 |
| VI | 145 | 142 | 142 | 146 | 159 |
| Coker % | n/a | n/a | n/a | n/a | n/a |
| N, in gms. | 0.01 | | | | |
| emulsion, mL | 0 | 0 | 0 | 0 | 1 |

As can be seen from Table 5, the polymer of Example A (used in Example 4) dramatically improves deposit control as indicated by the increase in the % unit rating. Example 5, which also includes a polyisobutylene succinimide dispersant, does not perform as well in terms of deposit control.

Regarding demulsibility, conventional Dispersant VI improvers (as used in Example 6) are not used in multigrade hydraulic lubricants because of their deleterious impact on water demulsibility In Example 7, the polymer of Ex. F is replaced with the polymer of Ex A such that the fluids are formulated to the same kinematic viscosity at 40° C. and contain the same level of nitrogen from their respective dispersant functionalities. The use of the polymer of Ex. A results in a dramatic improvement in water demulsification performance. The same level of demulsification performance is also observed with the polymer of Ex. B (Example 8).

The nature of the improved water demulse properties is a function of the polymer backbone composition rather than the nature of the dispersant amine used. This is shown in Examples 6 and 9, where water demulse is greatly improved using the polymer of Ex. D rather than polyalkyl(meth) acrylate used in Example 6, even though they contain the same dispersant amine DMAPA.

Hydraulic Vane Pump Deposit and Varnish Testing

An ISO46 multigrade hydraulic lubricant is formulated in an API Group II oil with polymer of Ex. A (Example 12) and a zinc-based antiwear hydraulic additive package. A comparative ISO46 multigrade hydraulic lubricant, Example 13, was formulated with polymer G, using the same additive package and base oil as Example 12. Both fluids were run for 1000 h in the Vickers' 35V025 vane pump test under the following conditions: Pressure=207 bar; Temperature=95° C.; Speed=2400 rpm.

The test is visually rated after 1000 h for the presence or absence of varnish in the sump. TABLE 6 shows the results obtained. The composition of Example 12 is observed to be superior in deposit and varnish control when compared to that of the composition of Example 13.

TABLE 6

Vane Pump Deposit and Varnish Testing

| Example | 12 | 13 |
|---|---|---|
| 100N Group II mineral oil | 21.4 | 14.2 |
| 220N Group II mineral oil | 72.3 | 80.3 |
| zinc-based antiwear hydraulic additive | 0.85 | 0.85 |
| polymethacrylate blend (pour point depressant) | 0.1 | 0 |
| Polymer A | 3.97 | |
| Polymer G (includes some oil, exact amount unknown) | | 4.7 |
| KV_100 | 7.99 | 7.82 |
| KV_40 | 46.92 | 45.17 |
| VI | 142 | 144 |
| Visual Appearance-observations of sump | Low to no varnish | Varnish clearly evident |

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon.

Examples of hydrocarbyl groups include:

(i) hydrocarbon substituents, that is, aliphatic (e.g., alkyl or alkenyl), alicyclic (e.g., cycloalkyl, cycloalkenyl) substituents, aryl, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups useful as hydrocarbyl groups may include at least 1, or at least 2, or at least 3, or at least 4 carbon atoms, and in some embodiments, up to 150, or up to 100, or up to 80, or up to 40, or up to 30, or up to 28, or up to 24, or up to 20 carbon atoms. Illustrative examples include methyl, ethyl, propyl, butyl, pentyl, hexyl, heptyl, octyl, 2-ethylhexyl, nonyl, decyl, undecyl, dodecyl, tridecyl, tetradecyl, hexadecyl, stearyl, icosyl, docosyl, tetracosyl, 2-butyloctyl, 2-butyldecyl, 2-hexyloctyl, 2-hexydecyl, 2-octyldecyl, 2-hexydodecyl, 2-octyldodecyl, 2-decyltetradecyl, 2-dodecylhexadecyl, 2-hexyldecyloctyldecyl, 2-tetradecyloctyldecyl, 4-methyl-2-pentyl, 2-propylheptyl, monomethyl branched-isostearyl, isomers thereof, mixtures thereof, and the like.

Representative alkenyl groups useful as hydrocarbyl groups include $C_2$-$C_{28}$ alkenyl groups, such as ethynyl, 2-propenyl, 1-methylene ethyl, 2-butenyl, 3-butenyl, pentenyl, hexenyl, heptenyl, octenyl, 2-ethylhexenyl, nonenyl, decenyl, undecenyl, dodecenyl, tridecenyl, tetradecenyl, hexadecenyl, isomers thereof, mixtures thereof, and the like.

Representative alicyclic groups useful as hydrocarbyl groups include cyclobutyl, cyclopentyl, and cyclohexyl groups.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecyiphenyl benzylphenyl, styrenated phenyl, p-cumylphenyl, α-naphthyl, β-naphthyl groups, and mixtures thereof.

Representative heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Hydrocarbylene groups are the divalent equivalents of hydrocarbyl groups, such as alkylene groups.

Each of the documents referred to above is incorporated herein by reference Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A hydraulic fluid comprising:

(a) at least 60 wt. % of a Group I or Group II base oil;

(b) 3.4 to 5.2 wt. % of an ester of a carboxy group-containing interpolymer comprising units derived from a vinyl aromatic monomer, the vinyl aromatic monomer comprising styrene, and units derived from a carboxylic acid monomer, the carboxylic acid monomer comprising maleic anhydride, the interpolymer also comprising nitrogen functionality provided by a nitrogen-containing moiety which comprises at least one of aminopropylmorpholine and dimethylaminopropylamine, the ester of the carboxy group-containing interpolymer having a weight average molecular weight of 30,000 to 70,000, the ester of a carboxy group-containing interpolymer including up to 0.44 wt. % nitrogen; and (c) at least one phosphate compound comprising zinc;

wherein the hydraulic fluid is at least substantially free of polyacrylates and polymethacrylates that contain, in total, at least 30 mol. % of at least one of acrylate and methacrylate units and have a weight-average molecular weight of at least 1500, such that said polyacrylates and polymethacrylates, in total, amount to no more than 0.3 wt. % of the hydraulic fluid; and wherein the hydraulic fluid includes, in total, less than 0.1 wt. % of nitrogen-containing ashless dispersants, other than the esterified interpolymer, the nitrogen-containing ashless dispersants being characterized by a nitrogen-containing functional group attached to a polymeric hydrocarbon backbone.

2. The hydraulic fluid of claim 1, wherein a mole ratio of units derived from maleic anhydride to units derived from styrene is from 0.9:1 to 1.1:1.

3. The hydraulic fluid of claim 1, wherein:

the ester of the carboxy group-containing interpolymer includes at least 0.01 wt. % nitrogen.

4. The hydraulic fluid of claim 1, wherein the ester of the carboxy group-containing interpolymer comprises esters of the carboxy groups formed by reaction of the carboxy groups with one or more alcohols having from 4 to 24 carbon atoms.

5. The hydraulic fluid of claim 1, wherein esters of the carboxy groups in the interpolymer are derived from an alcohol mixture comprising at least 50 wt. % of $C_8$ and higher linear alcohols.

6. The hydraulic fluid of claim 1, wherein esters of the carboxy groups in the interpolymer are derived from an alcohol mixture comprising at least 0.1 wt. % of $C_{18}$ and higher linear alcohols.

7. The hydraulic fluid of claim 1, wherein the nitrogen functionality is provided by the nitrogen-containing moieties condensed onto at least 5% of the carboxy groups of the interpolymer.

8. The hydraulic fluid of claim 1, wherein the ester of the carboxy group-containing interpolymer comprises at least 0.1 wt. % nitrogen.

9. The hydraulic fluid of claim 1, wherein the ester of the carboxy group-containing interpolymer comprises up to 0.25 wt. % nitrogen.

10. The hydraulic fluid of claim 1, wherein at least 90% of the units in the backbone of the ester of the carboxy group-containing interpolymer comprise the units derived from a vinyl aromatic monomer and the units derived from a carboxylic acid monomer.

11. The hydraulic fluid of claim 1, wherein the ester of the carboxy group-containing interpolymer comprises a maleic anhydride/styrene alternating copolymer, esterified with a mixture of alcohols comprising at least 80 wt. % of alcohols with 8 to 18 carbon atoms.

12. The hydraulic fluid of claim 1, wherein the ester of the carboxy group-containing interpolymer comprises less than 5 wt. % of units derived from methacrylic acid or acrylic acid.

13. The hydraulic fluid of claim 1, further comprising at least one of a pour point depressant, an overbased detergent, an antioxidant, and a corrosion inhibitor.

14. The hydraulic fluid of claim 13, wherein the pour point depressant comprises a polymethacrylate.

15. A method for lubricating a hydraulic system comprising pressurizing a hydraulic fluid in the hydraulic system, the hydraulic fluid comprising:

(a) at least 60 wt. % of a Group I or Group II base oil;

(b) 3.4 to 5.2 wt. % of an ester of a carboxy group-containing interpolymer comprising units derived from a vinyl aromatic monomer and units derived from a carboxylic acid monomer, the interpolymer also comprising nitrogen functionality, the ester of the carboxy group-containing interpolymer having a weight average molecular weight of 30,000 to 70,000, the ester of a carboxy group-containing interpolymer including up to 0.44 wt. % nitrogen; and (c) 0.05-0.5 wt. % of a zinc dialkyldithiophosphate, wherein the hydraulic fluid is at least substantially free of polyacrylates and polymethacrylates that contain, in total, at least 30 mol. % of at least one of acrylate and methacrylate units and have a weight-average molecular weight of at least 1500, such that said polyacrylates and polymethacrylates, in total, amount to no more than 0.3 wt. % of the hydraulic fluid; and wherein the hydraulic fluid includes, in total, less than 0.1 wt. % of nitrogen-containing ashless dispersants, other than the esterified interpolymer, the nitrogen-containing ashless dispersants being characterized by a nitrogen-containing functional group attached to a polymeric hydrocarbon backbone.

16. A hydraulic system comprising a pump and a device which is supplied with the hydraulic fluid of claim 1 by the pump.

17. The hydraulic fluid of claim 1, wherein the hydraulic fluid has a viscosity at 40° C. (KV_40), determined according to ASTM D2270-10e1, of from 30 to 80 cSt.

* * * * *